United States Patent [19]

Nakano

[11] Patent Number: 4,834,166

[45] **Date of Patent: * May 30, 1989**

[54] DIE CASTING MACHINE

[76] Inventor: Akio Nakano, 14-1, Ichikawaminami 3-chome, Ichikawa-shi, Chiba-ken, Japan

[ * ] Notice: The portion of the term of this patent subsequent to Mar. 1, 2005 has been disclaimed.

[21] Appl. No.: 723

[22] Filed: Jan. 6, 1987

[30] Foreign Application Priority Data

Jan. 10, 1986 [JP] Japan ..... 61-3015

[51] Int. Cl.[4] ..... B22D 17/04

[52] U.S. Cl. ..... 164/255; 164/316; 164/319; 164/342; 164/348; 164/410

[58] Field of Search ..... 164/120, 305, 303, 312, 164/319, 320, 321, 338.1, 342, 343, 348, 410, 316, 317, 318, 253, 254, 255

[56] References Cited

U.S. PATENT DOCUMENTS

| | | | |
|---|---|---|---|
| 3,433,292 | 3/1969 | McDonald | 164/343 |
| 3,664,411 | 5/1972 | Carver et al. | 164/303 |
| 4,079,911 | 3/1978 | Wirtz et al. | 164/338.1 |

FOREIGN PATENT DOCUMENTS

| | | | |
|---|---|---|---|
| 2846512 | 5/1980 | Fed. Rep. of Germany | 164/303 |
| 43-11881 | 5/1968 | Japan | 164/312 |
| 57-62846 | 4/1982 | Japan | 164/120 |
| 60-83762 | 5/1985 | Japan | 164/305 |

*Primary Examiner*—Richard K. Seidel
*Attorney, Agent, or Firm*—Klauber & Jackson

[57] ABSTRACT

This invention relates to a die casting machine in which high pressure is applied to molten metal to inject and fill the molten metal all over the mold before the molten metal is solidified to continuously mold molded articles (products), which have a beautiful casting surface and a high dimensional precision, every cycle of the machine. One or both of a fixed mold or a movable mold, which serves as a molding mold, and a core incorporated into one or both the molds are formed of high strength ceramics, and in addition, a movable hob for pressurizing molten metal injected and filled into both the fixed and movable molds is formed of high strength ceramics thereby providing a mold construction which is excellent in mechanical characteristics such as strength, hardness, breaking toughness and the like and having durability and pressure resistance enough to withstand high temperature thermal shock and high pressure, and being capable of easily controlling the temperature distribution within the mold. Furthermore, an injection sleeve for injecting and filling molten metal into the mold and a piston slidably inserted therein are formed of high strength ceramics to thereby eliminating a difference in temperature dropping speed between the surface portion of molten metal supplied into the injection sleeve and the center portion.

8 Claims, 17 Drawing Sheets

L : 120 B : 20 t : 8 W : 10 a : 70 C : 60 l : 40 R : 13
UNIT (mm)

DIE CASTING MACHINE

FIELD OF THE INVENTION

This invention relates to a horizontal or vertical die casting machine such as a hot chamber type, a cold chamber type, etc., in which high pressure is applied to molten metal to inject and fill the molten metal all over the mold before said molten metal is solidified to continuously mold a molded article (a product), which has a beautiful casting surface and a high dimensional precision every cycle of the machine, and particularly to a casting mechanism portion of the die casting machine for molding a molded article by use of high temperature melting metal up to a pouring temperature of approximately 600° to approximately 1,650° C. (high melting point metal), a so-called high temperature molten metal of approximately 600° to 1650° C.

DESCRIPTION OF THE PRIOR ART

Generally, in a die casting method, a piston slidably moved within an injection sleeve causes molten metal poured into the injection sleeve to be injected and filled into a molding portion or a so-called cavity of a molding mold formed by clamping a fixed mold and a movable mold, and pressure is retained till the molten metal is solidified. After being solidified, the molds are opened to remove a molded article molded within the cavity. The aforesaid casting step has to be repeatedly carried out under the severe operating conditions such that the injection sleeve is exposed to the molten metal at the same time the casting starts and the mold retains thermal shocks caused by pressing force and rapid cooling applied at the time of and after filling until the injected and filled molten metal is solidified. Particularly in case of high temperature molten metal up to 600° to 1650° C. or so, a further severe operating circumference exists.

In the case of the die casting method particularly using the high temperature molten metal up to 600° to 1650° C. or so under such a severe operating circumference, the following conditions are required:

(1) Excellent mechanical properties such as strength, hardness, breaking toughness, etc. with respect to high temperature molten metal up to 600° to 1650° C. or so;

(2) Excellent durability such as thermal shock resistance, chemical resistance, oxidation resistance, wear resistance, etc. with respect to high temperature molten metal up to 600° to 1650° C.;

(3) Excellent pressure resistance withstanding compression (pressing) strength above injection filling pressure; and (4) Excellent heat retaining properties not to allow a rapid temperature drop of molten metal, thermal shock resistance capable of withstanding rapid cooling, and the like.

However, in the conventional molds, both fixed and movable molds are general metal molds which are formed of SKD61 (heat resisting metal) as a main material. Therefore, these molds have a difficulty not capable of withstanding high temperature thermal shock received from high temperature molten metal up to 600° to 1650° C. or so. They become severely eroded. When the molds once receive a damage caused by high temperature thermal shock and high pressure, they become rapidly fractured and broken, resulting in a complete crack or breakage. Thus, it is extremely difficult and impossible to provide a durable construction.

Recently, molds used for high temperature molten metal have been proposed which include a casting mold having a good venting property made by forming ceramics powder into porous configuration and calcining the same, and an atmospheric $Si_3N_4$ group mold formed of atmospheric $Si_3N_4$($Si_3N_4$ group ceramics) which are said to have excellent thermal shock resistance, chemical resistance and oxidation resistance. These molds are excellent as compared with metal molds but have difficulties in that the strength, hardness and breaking toughness with respect to high temperature molten metal up to 600° to 1650° C. are low and the thermal shock resistance and chemical resistance are poor. Anyhow, it is a present state that measures for extending the service life of conventional molds do not yet bring forth improvements and effects as desired.

Furthermore, since the conventional metal (SKD61) mold has a high thermal conductivity, it is difficult to control the temperature distribution of the mold as a whole. As a consequence, when molten metal is injected and filled into the cavity, the temperature of molten metal rapidly drops which causes unsatisfactory movement of molten metal, thus posing problems such as a failure of obtaining molded articles with high dimensional accuracy, poor mechanical properties, and the like.

Moreover, since the injection sleeve serving as an injection opening of molten metal into the cavity of the mold and the piston reciprocatingly slidably moved within the sleeve are likewise formed of SKD61 (heat resisting metal) as a main material, satisfactory heat retaining properties of high temperature molten metal up to 600° to 1650° C. or so not to produce solidified pieces, solidified films and the like cannot be expected. Thermal stress applied to the sleeve and piston reaches several times due to the presence of pressure under which high temperature molten metal is injected and sliding frictional heat, and conventional metal and ceramics have been impossible to use in terms of material.

Therefore, when high temperature molten metal is supplied into the injection sleeve (pot), a part of molten metal in contact with inner surfaces of walls of the injection sleeve is rapidly cooled to a temperature at which solidification starts to produce solidified pieces, solidified films and the like on said portion, and said solidified pieces, solidified films and the like are caught into the cavity of the mold and mixed in such a state that they are not melted with the interior of a molded article. That is, this greatly affects formation of a structure of molded article into extreme fineness and combining structure of alloys of various elements, greatly impairs mechanical properties of molded articles such as strength and hardness, and fails to expect high precision of molded articles.

OBJECTS AND SUMMARY OF THE INVENTION

An object of the present invention is to provide a construction of a casting mold and a sleeve which is excellent in mechanical properties such as strength, hardness, breaking toughness and the like with respect to high temperature molten metal up to 600° to 1650° C. or so and has satisfactory durability and pressure resistance capable of withstanding high temperature thermal shocks and high pressure.

A further object of the invention is to facilitate a control of distribution of mold temperature within the mold when molten metal is injection and solidified.

Another object of the invention is to effectively and promptly remove, from the mold, gases (air) caught into the mold when molten metal is injected, and gases generated when molten metal is solidified.

Another object of the invention is to maintain molten metal supplied into the injection sleeve at a suitable heat retaining level.

Still another object of the invention is to smooth forward and backward movement of a movable mold when a mold is closed or opened and to accurately effect adjustment between the movable mold and a fixed mold.

Other objects of the invention will be apparent from the ensuing detailed description of the invention, the drawings and the graphs.

These objects are achieved by the die casting machine proposed by the present invention. This die casting machine comprises a casting mold composed of a fixed mold mounted and held on one of fixed platens disposed in a suitably spaced relation and provided with a pressure-adding element or a core formed of high strength ceramics and a movable mold mounted and held through a movable plate on a tie bar mounted between both the fixed platens and provided with a movable hob or a core formed of high strength ceramics, one or both of the fixed mold and movable mold being formed of high strength ceramics, an injection sleeve for injecting and filling molten metal into both the fixed and movable molds and a piston slidably inserted into said injection sleeve, said injection sleeve and said piston being formed of high strength ceramics, a heating and cooling mechanism provided on both said fixed and movable molds, a suction and vent mechanism provided on both the fixed platens, said tie bar and said movable plate.

BRIEF DESCRIPTION OF THE DRAWINGS

FIG. 2 is a sectional view in an enlarged scale taken on line (II)—(II) of FIG. 1, FIG. 3 being a sectional view in an enlarged scale taken on line (III)—(III) of FIG. 1, FIG. 4 being a longitudinal sectional front view showing a state wherein molds are opened to remove a molded article;

DETAILED DESCRIPTION

Figure 1:
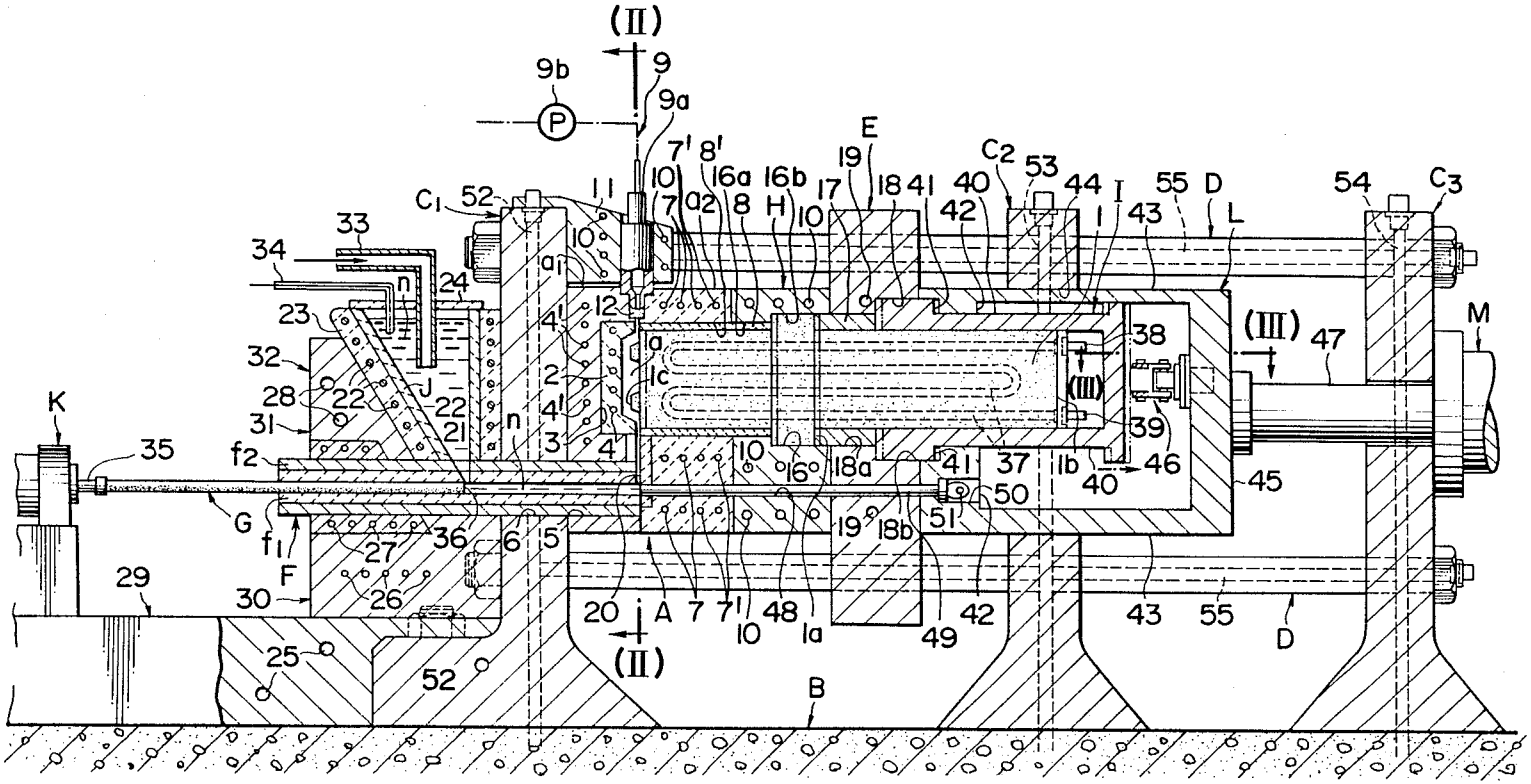
FIGS. 1 to 4 show a die casting machine according to the present invention, FIG. 1 being a longitudinal sectional view.

Embodiments of the present invention will be described in detail hereinafter with reference to the drawings. FIGS. 1 to 4 show a die casting machine of a horizontal type and a laterally injecting system. Reference character A designates a casting mold composed of a pair of a fixed mold $a_1$ and a movable mold $a_2$. Reference numeral 1 designates a pressure-adding element and 2 a core. The fixed mold $a_1$ is mounted on and held by one of fixed platens $C_1$ and $C_2$ stood upright in parallel with each other in a suitable spaced relation on a base frame B, and the movable mold $a_2$ is mounted on and held, through a movable plate E, on tie bars D . . . laterally mounted between both the fixed platens $C_1$ and $C_2$ so that the movable mold $a_2$ is opposed to the fixed mold $a_1$. After both the fixed and movable molds $a_1$ and $a_2$ have been closed, molten metal n as material for a cast article N is injected and filled into a molding portion or a so-called cavity a by a piston G which is slidably moved forward and backward within an injection sleeve F, and the molten metal n is pressed and solidified while applying a compressive force thereto by the pressure-adding element 1, to mold a cast article N.

The molten metal n is not particularly limited in material thereof but preferably comprises a super plastic metal, which includes, for example, a Zn group alloy using Zn as a main material and consisting of 0–68 wt % Al, 0–5 wt % Si, 0–50 wt % Cu, 0–98 wt % Mg, 0–50 wt % Mn, 0–2O wt % Fe, 0–2O wt % Ti, 0–30 wt % Ni, 0–20 wt % Cr, 0–3 wt % Pb, 0–10 wt % Sn, 0–10 wt % Be, 0–5 wt % P, 0–60 wt % C, 0–15 wt % W, 0–10 wt % B, 0–20 wt % Co, 0–80 wt % Ag, 0–20 wt % Pd, 0–20 wt % Sb; an Al group alloy using aluminum Al as a main material and consisting of 0–30 wt % Si, 0–40 wt % Cu, 0–98 wt % Mg, 0–40 wt % Zn, 0–30 wt %, Mn, 0–20 wt % Fe, 0–20 wt % Ti, 0–40 wt % Ni, 0–20 wt % Cr, 0–3 wt % Pb, 0–3 wt % Sn, 0–10 wt % C, 0–10 wt % Be, 0–3 wt % W, 0–40 wt % Ag, 0–20 wt % B, 0–20 wt % Sr, 0–20 wt % Li, 0–5 wt % Zr, 0–5 wt % Na, 0–5 wt % Sb, 0–5 wt % Cd, 0–20 wt % Mo, 0–40 wt % Pd; a Cu system alloy using copper Cu as a main material and consisting of 0–50 wt % Si, 0–40 wt % Al, 0–20 wt % Mg, 0–50 wt % Zn, 0–40 wt % Mn, 0–20 wt % Fe, 0–20 wt % Ti, 0–40 wt % Ni, 0–30 wt % Cr, 0–5 wt % Pb, 0–20 wt % Sn, 0–30 wt % C, 0–5 wt % Be, 0–10 wt % W, 0–20 wt % B, 0–5 wt% Sb, 0–20 wt % Li, 0–40 wt % P, 0–30 wt % Zr, 0–5 wt % Se, 0–40 wt % Pd, 0–40 wt % Ag; and an Fe group alloy using iron Fe as a main material and consisting of 0–60 wt % C, 0–40 wt % Mn, 0–30 wt % Si, 0–30 wt % Cr, 0–40 wt % Ni, 0–20 wt % Mo, 0–20 wt % V, 0–20 wt % P, 0–10 wt % S, 0–10 wt % Pb, 0–20 wt % Sn, 0–20 wt % Be, 0–30 wt % Ag, 0–50 wt % Cu, 0–80 wt % W, 0–20 wt % B, 0–20 wt % Li, 0–20 wt % Zr, 0–40 wt % Pd.

A body portion of the fixed mold $a_1$ is formed of a low expansion metal and has a recess portion for a core installing portion 3, into which a core 2 formed of high strength ceramics is fitted to constitute a core type mold construction, within which a heating mechanism 4' and a cooling mechanism 4 are disposed.

In the fixed mold $a_1$, the body portion formed of low expansion metal is sometimes different from the core 2 made of high strength ceramics in the coefficient of thermal expansion according to a temperature area due to the difference in material of mold. Therefore, between the inner peripheral surface of the recess of the core installing portion 3 and the outer peripheral surface of the core 2 is interposed a shape memory alloy storing the difference in the coefficient of thermal expansion therebetween so as to absorb it to prevent a clearance from producing due to the difference in the coefficient of thermal expansion therebetween. In addition, a sintered alloy over the entire circumference is disposed in a desired position, for example, a position not to contact with the molten metal n, between the outer peripheral surface of the shape memory alloy and the inner peripheral surface in the recess of the core installing portion 3.

The body portion of the fixed mold $a_1$ is formed with a sleeve receiving hole 5 which extends therethrough thicknesswise, said hole 5 being positioned on an axially extending line of a sleeve receiving hole 6 formed in the fixed platen $C_1$ and mounted on the latter.

The movable mold $a_2$ comprises a high strength ceramics mold, within which are provided a heating mechanism 7' and a cooling mechanism 7, and in a central portion opposed to the core 2 of the fixed mold $a_1$ is formed a receiving opening 8' in which the pressure-adding element 1 is received movably forward and backward through a sliding frame ring 8, and the movable mold $a_2$ is mounted on the movable plate E through a mounting frame bed H so that the former is opposed to the fixed mold $a_1$.

A suction mechanism 9 is incorporated in a suitable location of the fixed and movable molds $a_1$ and $a_2$, and in the drawing, between separating surfaces of both the molds $a_1$ and $a_2$.

The suction mechanism 9 serves to draw and remove, from the cavity a, air present in the cavity a when molten metal n is injected and filled or air caught therein, and serves to make the interior of the cavity a negative pressure to improve movement of molten metal n, i.e., enhance the filling density thereof. A suction pipe **9*a* is connected to the separating surface between the fixed and movable molds $a_1$ and $a_2$ while being brought into communication with the cavity a, said suction pipe 9*a* being operatively connected to a vacuum device 9*b*. The suction pipe 9*a* extends through and is supported on a mounting frame body 11 provided with a cooling mechanism 10 mounted to be arranged above the fixed platen $C_1$, and a porous vent material having a heat resistance, for example, porous ceramics 12 is provided on the forward end of the suction pipe 9*a* whereby only air and gases may be removed so that molten metal automatically stops when the former directly impinges upon the ceramics 12**, thus eliminating an inaccuracy of the presumed removing method that may not be achieved by prior process.

In a position facing to a thick-wall portion of a molded article N between the separating surfaces cf both the fixed and movable molds $a_1$ and $a_2$, and more specifically, in a central portion facing to a thick-wall portion in the atmosphere of a large quantity of heat where produced gases are liable to produce when the injected and filled molten metal n is solidified, a gas vent passage 13 in communication with the cavity a is made to extend therethrough, said gas vent passage 13 incorporating therein a gas vent mechanism 14.

Figure 2:
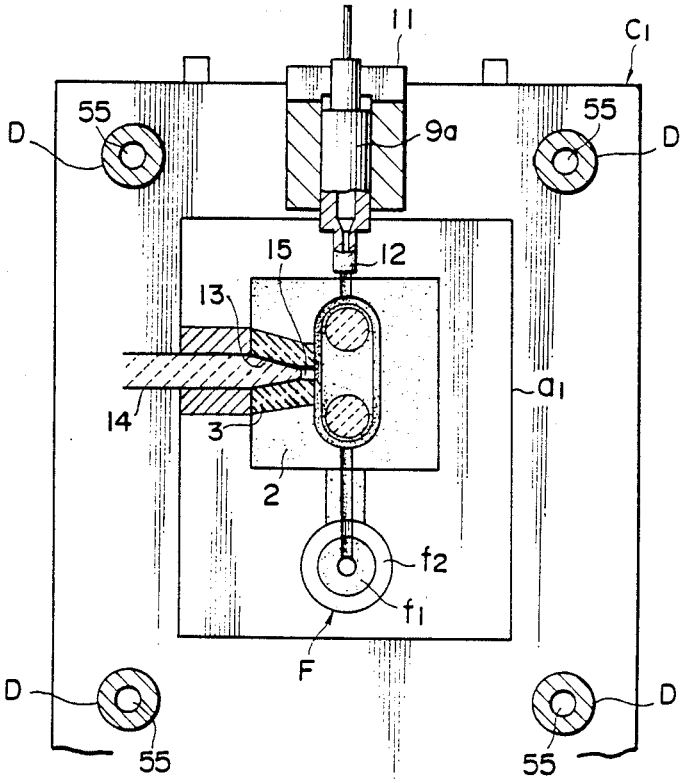
Figure 3:
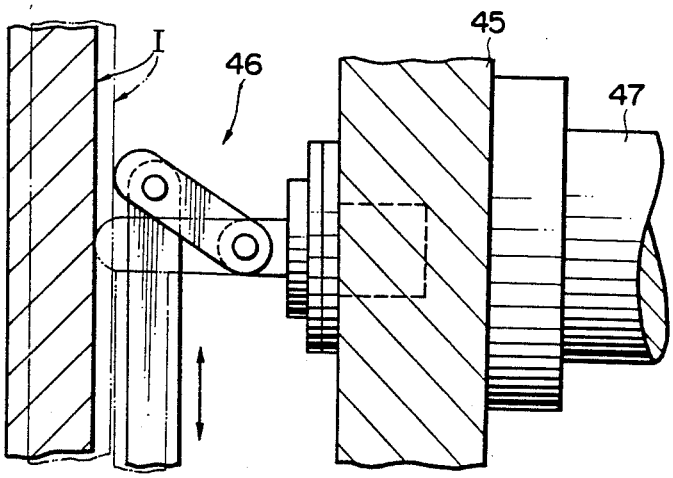
Figure 4:
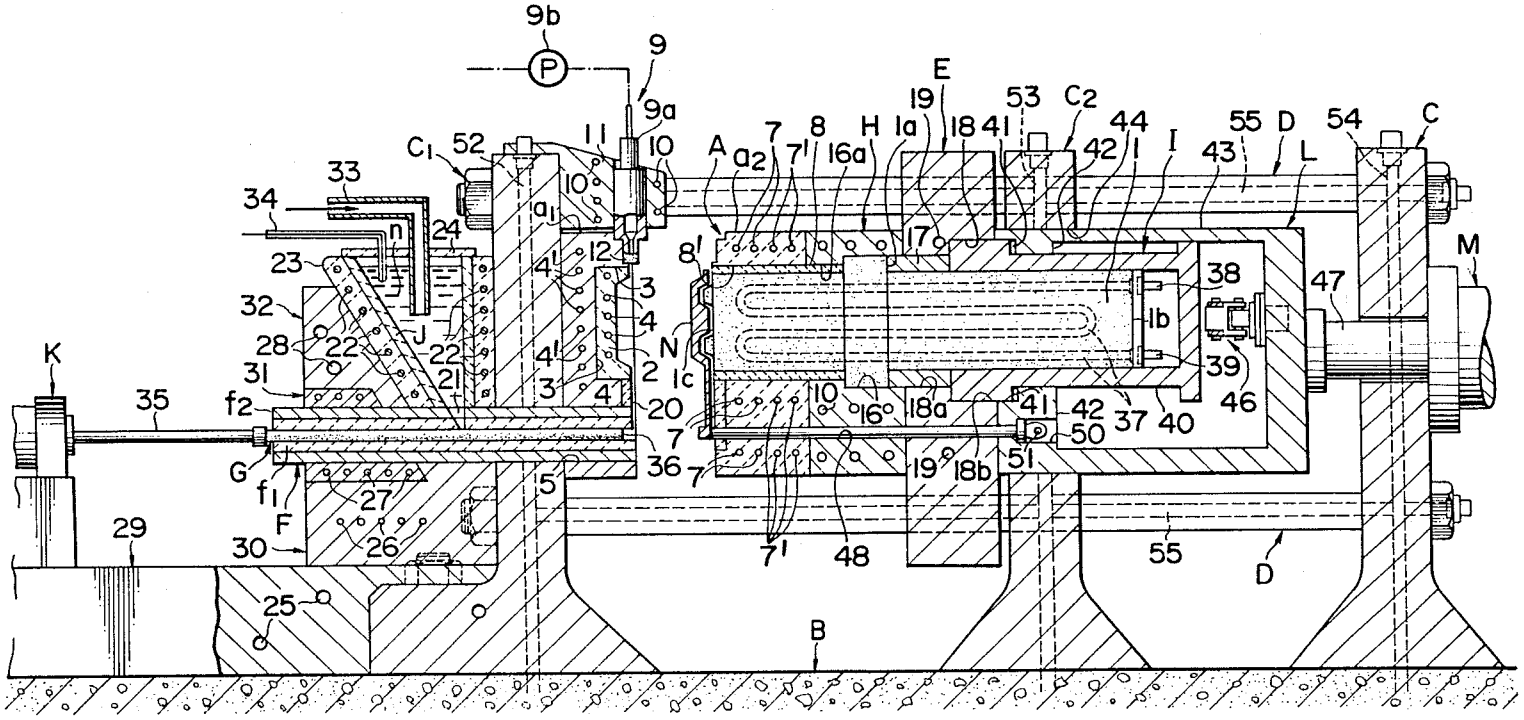

The gas vent mechanism 14 comprises a gas vent plug generally in the form of a conical rod formed of porous vent material having a heat resistance, for example, porous ceramics or various shapes of high strength ceramics which is closely fitted to be directed toward a reservoir 15 formed in a part in the vicinity of an inlet of the gas vent passage 13 for forward and backward movement. As shown in FIG. 2, the gas vent mechanism 14 is inserted and detachably held within the body portion of fixed mold $a_1$ and the core 2. The gas vent plug is moved backward at a predetermined timing generally at the same time when the pressure-adding element 1 is moved forward (pressing), and more specifically immediately after a solidified film is formed on the surface of the molten metal n such as a thick-wall portion in the atmosphere of a large quantity of heat to force the produced gases produced in the thick-wall portion into the gas vent passage 13 including the reservoir 15. The gas vent mechanism 14 is operatively connected to a driving source (not shown) for forward and backward movement by the operation of said source.

The mounting frame bed H is formed in the central portion thereof with a stepped connection opening 16 which is provided at one half portion thicknesswise thereof with a portion **16*a* having the same diameter as that of the opening 8' of the movable mold $a_2$ and at the other half portion with a large diameter portion 16*b* having a larger diameter than that of said portion 16*a***.

The movable plate E, which is formed of a known metal, is formed with a stepped receiving opening 18 provided in the central portion thereof with, at one half portion thicknesswise, a portion **18*a* having the same diameter as that of the large diameter portion 16*b* and receiving a pressing movable frame ring 17 over the large diameter portion 16*b*, and at the other half portion, a large diameter portion 18*b* having a larger diameter than that of said portion 18*a* and receiving one end part of the pressing machine frame I, a cooling mechanism 19** being disposed in a suitable location, and four corner parts are inserted and supported over four tie bars D between fixed platens $C_2$ and $C_2$ disposed on the base frame B for forward and backward movement.

An injection sleeve F comprises a double tubular construction comprising both inner and outer tubes $f_1$ and $f_2$, said inner tube $f_1$ being formed of high strength ceramics, said outer tube f2 being formed of low expansion metal or heat resisting metal (including sintered metal), which are fitted and inserted into a sleeve receiving hole 6 formed in the fixed platen $C_1$ and a sleeve receiving hole 5 formed in the fixed mold $a_1$ and mounted and held in a horizontal direction, an opening at one end thereof being connected to a sprue 20, an opening at the other end being projected through a desired amount from the fixed platen $C_l$.

A molten metal storing container J is connected and communicated with a feed opening 21 bored in the vicinity of a projecting distal end of a projecting tubular portion of the injection sleeve F.

The container J, which is formed of high strength ceramics, has a heat retaining member 23 formed of high strength ceramics mounted on the outer surface thereof, said member 23 integrally housing therein a heating wire or member 22 serving as a heating source so as to maintain the stored molten metal n at a given temperature. An opening of the container J may be closed with a cover 24 formed of high strength ceramics so as to prevent oxidization of the molten metal n and secure the heat-retaining effect.

The container J and the projecting tubular portion of the injection sleeve F are fixed and held by a mounting bed 29, a sleeve receiving bed 30, a sleeve cooling tubular bed 31 and a container receiving bed 32 individually internally provided with cooling mechanisms 25, 26, 27 and 28, respectively. The outer circumferential portion of the injection sleeve F is suitably ccoled by the cooling mechanism 27 of the sleeve cooling tubular bed 31 holding the injection sleeve F to suitably control the temperature of the outer circumferential portion of the sleeve F, more specifically to control the temperature of the outer tube $f_2$ so that the coefficient of thermal expansion of the metal outer tube $f_2$ may correspond to that of the ceramics inner tube $f_1$ caused by the high temperature molten metal n up to 600° to 1650° C. or so thereby preventing a play from forming due to the difference in the coefficient of thermal expansion between the tubes $f_1$ and $f_2$ and preventing the ceramics inner tube $f_1$ from breakage.

Through the cover 24 is connected a feed pipe 33 connected to a parent furnace such as a melting furnace so that molten metal n may be periodically supplied from the parent furnace into the storing container J, and a temperature detection rod 34 also extends through the cover 24 to electrically control the temperature of molten metal.

The piston G, which is formed of high strength ceramics and in the form of a rod having one and the same diameter over the full length thereof, has one end portion slidably fitted into the injection sleeve F and the other end connected to the forward end of a rod 35 of an injection cylinder K installed on the mounting bed 29.

The injection cylinder K is operatively connected to the die casting machine so that when the molten metal n is injected, the piston G may be moved forward; the piston G is allowed to wait at its forward limit till the casting steps including solidification, opening, ejection of products and clamping is terminated; when the clamping is terminated, the piston is moved backward till a push surface 36 of the piston G returns to a position at the rear of the opening 21 of the injection sleeve F so that the molten metal n of the container J flows into the injection sleeve F through the opening 21; and the piston is allowed to wait at its backward limit till next instruction is received.

It is noted that as in the present embodiment, the piston G is not limited to its sliding forward and backward movement but may pour molten metal to the opening 21 one at a time.

The pressure-adding element 1 comprises an element of high strength ceramics, which has a shape having the outside diameter which is the same as the inside diameter of the sliding frame ring 8 and pressing moving frame ring 17 and has a length from the opening 8' of the movable mold $a_2$ to the stepped opening 18 of the movable plate E through the stepped connecting opening 16 and projecting rearwardly of the back of the movable plate E with a desired amount from said stepped opening 18, said hob having a collar 1*a* integral therewith, said collar being slidably positioned within the large diameter portion 18*b* of the opening 18 and having the same diameter as that of the portion 18*b* and having a predetermined width.

Within the pressure-adding element 1 is disposed a cooling mechanism 37 for circulating cooling water along the lengthwise direction thereof, said cooling mechanism having one side directed from the rear surface 10 side on one side thereof toward a part in the vicinity of the cavity forming surface 1*c* on the other side. Cooling valves 38 and 39 are individually provided in the opening of the rear surface 1*b* of the cooling mechanism 37. One of the cooling valves 38 and 39 serves as an inlet for cooling water and the other serving as a return port.

In the thus formed pressure-adding element 1, a portion from the collar 1*a* to the cavity forming surface 1*c* is slidably fitted in a sliding frame ring 8 retained between the full length within the opening 8' of the movable mold $a_2$ and the portion 16*a* of the stepped connecting opening 16 of the frame H with the collar 1*a* positioned in sliding contact with the large diameter portion 16*b* of the opening 16. The pressing moving frame ring 17 is disposed so as to impinge upon the back of the collar 1*a* and to extend from the large diameter portion 16*b* of the stepped connecting opening 16 of the frame H to the portion 18*a* of the stepped receiving opening 18 of the movable plate E, and one end part of the pressing machine frame I is inserted into the large diameter portion 18*b* of the stepped receiving opening 18 so as to impinge upon the ring 17, whereby the pressure-adding element 1 is incorporated from the movable mold $a_2$ to the movable plate E through the frame H and in a state projected at the rear of the back of the movable plate E.

The pressing machine frame I has its section of approximately ⊐-shape wherein the distance between arms is the same as the diameter of the outer surface of the pressure-adding element 1, and has ring keep portions 41, which have the same diameter as that of the large diameter portion 18*b* of the stepped receiving opening 18, formed at the forward ends of the arms 40. The frame I is set in from the rear surface 1*b* side so as to support the part on the rear surface 1*b* in a gripping state near the collar 1*a* of the pressure-adding element 1, the ring keep portions 41 being slidably fitted into the large diameter portion 18*b* of the stepped receiving opening 18 of the movable plate E.

In the drawing, L designates a mold-closing machine frame, which has its section of generally ⊐-shape having arms 43, 43 projectingly provided with guide portions 42, 42 on the inner surfaces thereof to slidably support the outer portions of the arms 40, 40 of the machine frame I, said frame L being slidably supported within a supporting opening 44 bored in the fixed platen $C_2$, and the forward ends of the arms 43, 43 are affixed to the movable plate E for forward and backward movement of the movable plate E.

On the inner surface of a frame portion 45 for the arms 43, 43 of the machine frame L is mounted a crank mechanism 46 to start forward movement of the frame I when the compressive force is applied to the molten metal n filled in the cavity a, and the forward end of a rod 47 of a clamping cylinder M is affixed to the outer surface of the frame portion 45.

The clamping cylinder M is mounted and held on a fixed platen $C_3$ stood upright parallel with and in a suitably spaced relation with the fixed platen $C_2$, and the rod 47 is made to extend through the frame 45 of the machine frame L with the forward end thereof affixed to the frame 45. Reference numeral 48 denotes an axial hole which is formed in communication with the movable mold $a_2$, the mounting frame H and the movable plate E. An extrusion movable pin 49 is inserted over the full length of the axial hole 48 so as to communicate with the latter and impinge upon an extrusion mechanism 51 within a recess 50 provided in the guide portion 42 of the clamping frame L so that the rotation of the extrusion mechanism 51 causes the movable pin 49 to forcibly move forward (extrusion operation) and after the mold has been opened, the molded article N may be extruded from the movable mold $a_2$.

In the present embodiment, cooling mechanisms 52, 53, 54 and 55 are respectively provided on the fixed platens $C_1$, $C_2$ and $C_3$ and the tie bars D . . . laterally mounted over and between the fixed platens $C_1$, $C_2$ and $C_3$ to impart the platens $C_1$, $C_2$, $C_3$ and the tie bar D . . . a heat resisting rigidity such as thermal shock resistance. Suitably, the tie bars D . . . can be of a double pipe construction composed of a ceramics inner pipe and a metal outer pipe. Conversely, the inner pipe can be of a metal pipe and the outer pipe can be of a ceramics pipe.

Consideration should be taken so that both the fixed and movable molds $a_1$ and $a_2$ may be accurately registered and engaged with each other in order to avoid strains resulting from the thermal expansion caused by thermal shocks such as the transfer of heat transmitted from the molten metal n up to 600° to 1650° C. injected and filled into the cavity a repeatedly received by the die casting machine during the casting operation to provide the smooth movement of the movable mold $a_2$ without stoppage during the movement thereof due to the excessive load stress at the time of forward and backward movement (sliding operation) of the movable mold $a_2$ when both the fixed and movable molds $a_1$ and $a_2$ are clamped and opened, and in order to avoid formation of a clearance between the separating surfaces of both the molds $a_1$ and $a_2$ because of unregistration therebetween and further in order to avoid a damage of uneven portions of both the molds $a_1$ and $a_2$ forming the cavity a caused by collision with each other due to a deviation therebetween.

The movable hob (frame) ring mechanism need not be a large-scaled mechanism according to the temperature of molten metal to be cast, the required accuracy, strength and shape but can be a simple construction such that a rapid cooling device and a pressing mechanism are mounted on the mold A and the pressure-adding element 1, respectively.

Next, the composition of the high strength ceramics used in the present embodiment will be described hereinafter.

Such high strength ceramics comprises a solid solution having a construction of $\alpha$-$Si_3N_4$, which is hot press $\alpha$-sialonic ceramics or atmospheric sintered $\alpha$-sialonic ceramics comprising a fine composite composition phase called a "partial stabilized" $\alpha$-sialonic region where 60 vol % of $\alpha$-sialonic granular crystal represented by $Mx\ (Si, Al)_{12}\ (O, N)_{16}$ (where M is Mg, Ca, Y, etc.) and 40 vol % of $\beta$-$Si_3N_4$ columnar crystal coexist, which is excellent in mechanical properties such as strength, hardness, breaking toughness, etc. and excellent in thermal shock resistance, chemical resistance and oxidation resistance.

Figure 5:
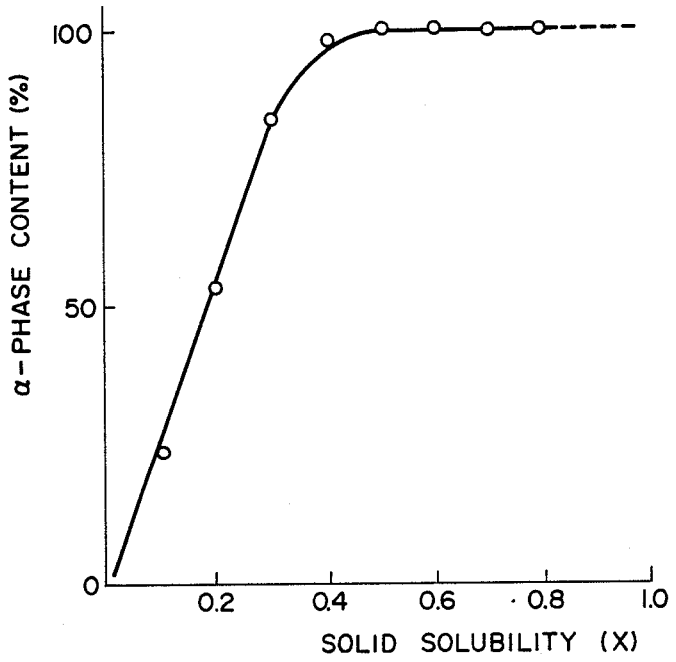
FIG. 5 is a graph showing a composition of high strength ceramics of the present invention (the relationship between the solid solubility (x) and phase content of α-sialon )

However, as shown in FIG. 5, the content of $\alpha$-sialon phase is 80% at solid solution (x)=0.3, and approximately 100% at x=0.4, according to which results, at x=0.4 or less, a two-phase region consisting of $\alpha$-sialon and $\beta$-$Si_3N_4$ results, which is a range of composition called the "partial stabilized" $\alpha$-sialon region, characterized by excellent mechanical properties such as strength, hardness, breaking toughness, etc. and excellent thermal shock resistance, chemical resistance, oxidation resistance, etc.

In the following, the operation of the die casting machine constructed as described above will be explained. The clamping cylinder M is actuated to move the movable plate E forward to adjust the movable mold $a_2$ to the fixed mold $a_1$. At that time, the piston G awaits at the forward limit where the opening 21 of the injection sleeve f is closed, and almost simultaneously with the termination of the clamping, the injection cylinder K actuates to move backward the piston G to the backward limit thereof where the molten metal pushing surface 36 is positioned at the rear of the opening 21. The molten metal n within the container J flows into the injection sleeve F (pot) from the opening 21 to be opened by the movement of the piston G to its backward limit.

When the molten metal n flows into the injection sleeve F, the injection cylinder F again actuates to move forward the piston G to inject the molten metal n into the cavity a. At that time, the cooling mechanisms 4 and 7 and the heating mechanisms 4' and 7' disposed on the fixed and movable molds $a_1$ and $a_2$ are respectively actuated to adequately cool and heat the cavity a and inject the molten metal n into the cavity n while controlling the temperature distribution of the cavity a. Almost simultaneously with the start of injection, the vacuum device **9*b* is actuated to forcibly remove the air caught into the cavity a through the suction pipe 9*a***.

Simultaneously with the termination of injection of the molten metal n, the crank mechanism 46 is actuated (two-dotted chain lines of FIG. 3) to move forward the movable hob 1 to press the filled molten metal n within the cavity a. At a predetermined timing from the commencement of said pressing, the gas vent mechanism (gas vent plug) 14 is instantaneously moved backward through a predetermined amount to extrude and discharge the produced gases of the thick-wall portions or the like which are solidified later than other portions into the gas vent passage 13 including the reservoir 15 by the pressure of the movable hob 1.

Thereafter, the step proceeds to the molding before mold opening. In the early stage of this step, the heating mechanisms 4' and 7' are actuated to adequately heat the cavity a, after which the cooling mechanisms 4 and 7 are actuated to drop the temperature down to the section and range of solidification of the molten metal n to mold a molded article N. Thereafter, the clamping cylinder M is actuated to move backward the movable plate E to open the mold, and the extrusion mechanism 51 is rotated to move forward the movable pin 49 to remove the article N from the movable mold $a_2$. At that time, the vacuum device **9*b* of the suction mechanism 9 is stopped and the crank mechanism 46 is actuated to disengage it from the machine frame I (solid line in FIG. 3**), and at the time of the subsequent casting (shot), the movable hob is moved backward by the injection pressure of the molten metal n filled into the cavity a.

Thereafter, the above-described operations are repeatedly carried out to cast articles N.

Comparison will be made hereinafter of the strength, fatigue, limit of use and heat retaining properties of molds between the present casting method and the prior casting method.

Strength

Figure 7:
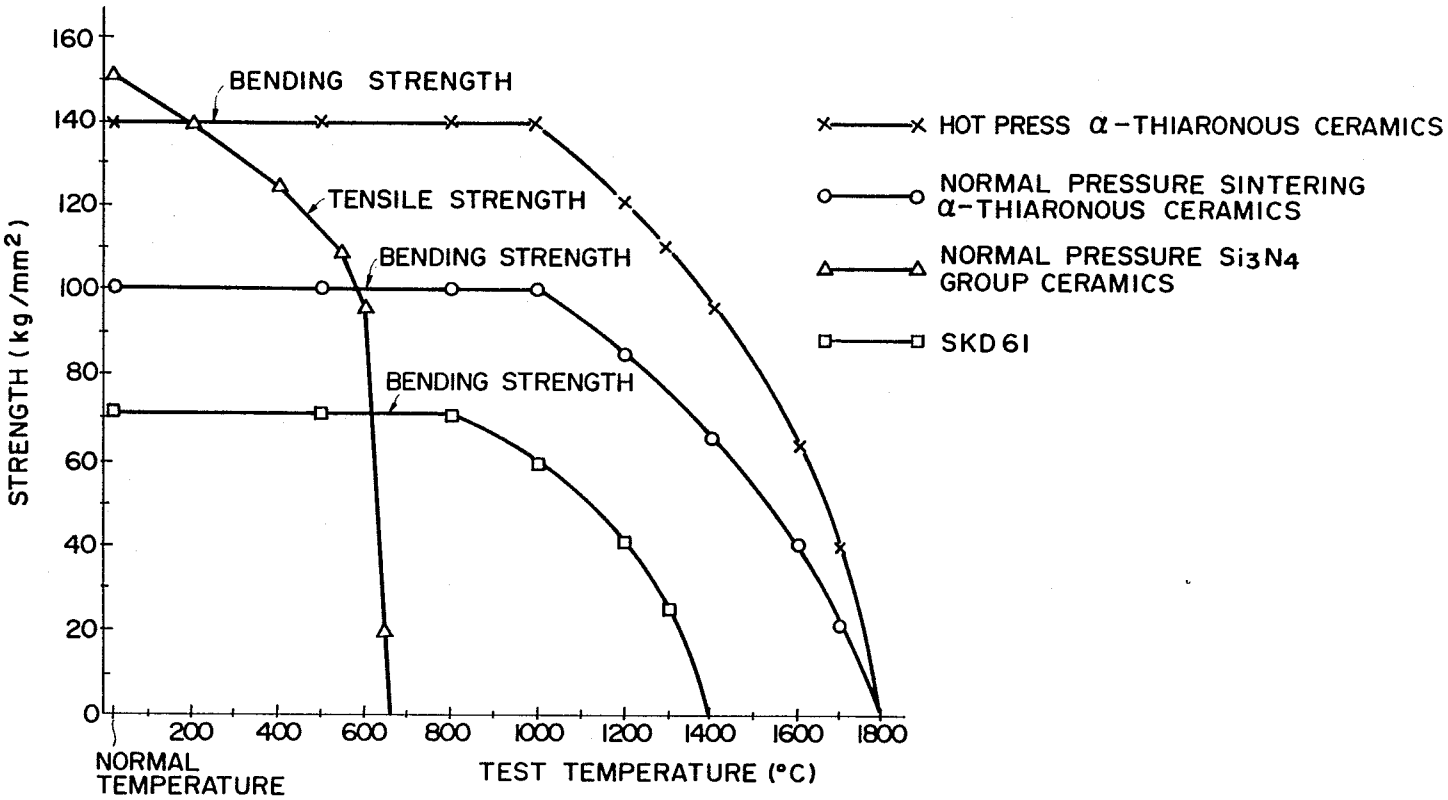
FIG. 7 is a graph comparing the bending strength with the tensile strength of the molds.

The strengths of various mold materials according to the variation in temperature are tested under the experimental conditions and the results obtained therefrom are shown in FIG. 7. Here, the ceramics is represented by the bending strength and the metal is represented by the tensile strength.

As will be apparent from FIG. 7, in the case of atmospheric $Si_3N_4$ group ceramics according to the prior casting method, the bending strength is 70 Kg/mm$^2$ from normal temperature to 800° C. or so, and in the case of SKD 61 (metal), the tensile strength is 150 Kg/mm$^2$ at normal temperature but lowers when exceeding 550° C., and thereafter rapidly lowers. On the other hand, in the case of atmospheric sintered α-sialonic ceramics according to the present casting method, the bending strength is high up to 100 Kg/mm$^2$ from normal temperature to 1,000° C., and in case of hot press α-sialonic ceramics, the bending strength is further high up to 140 Kg/mm$^2$ up to 1,00° C. or so.

It has been found therefore that the α-sialonic ceramics mold material according to the present casting method is excellent in mechanical properties which is higher in strength in a higher temperature area than those of the atmospheric $Si_3N_4$ group ceramics and SKD 61 mold material according to the prior casting method.

Fatigue

Figure 9:
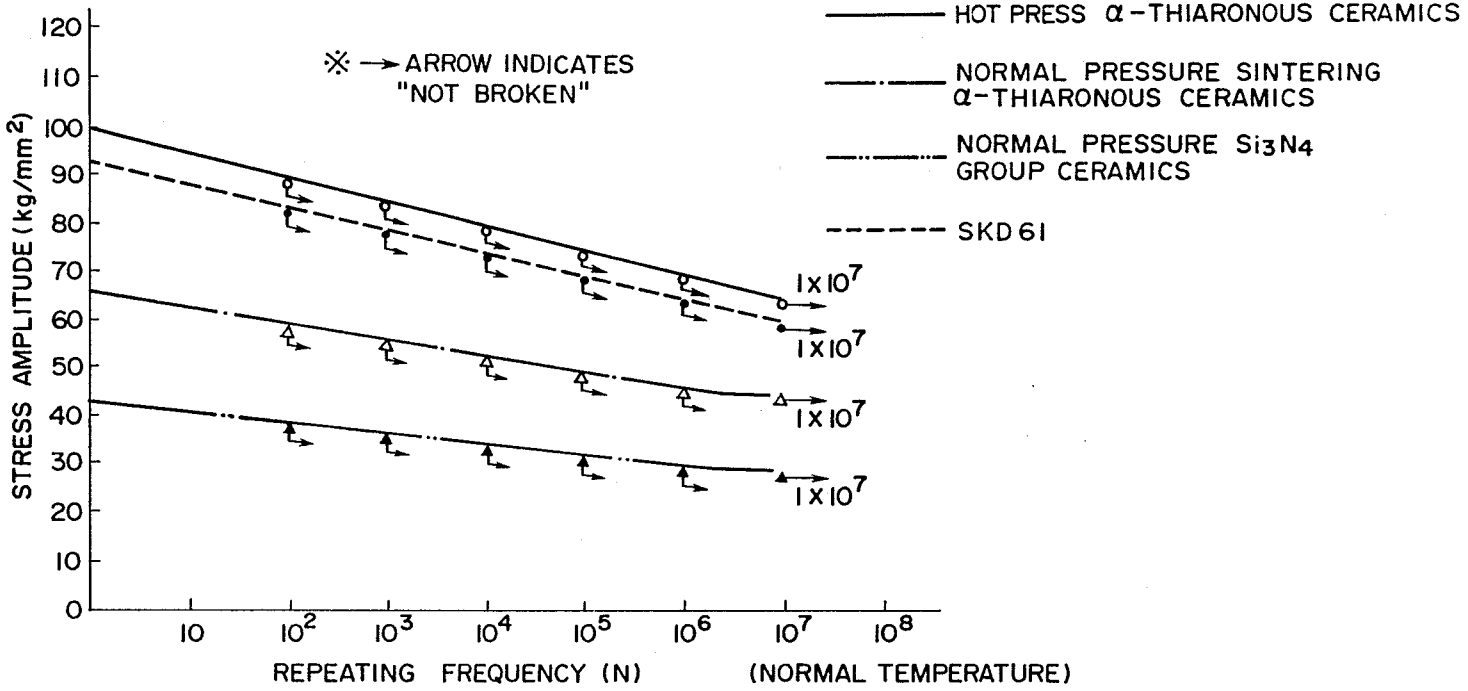
FIG. 9 is a graph for comparison of the fatigue strength of the molds.

The fatigues of various mold materials at normal temperature are tested under the experimental conditions given in Table 2 and the results obtained therefrom are shown by S-N curves of the stress amplitude and repeating frequency in FIG. 9.

As will be apparent from FIG. 9, comparing by the repeating frequency of $1\times10^7$, in case of the atmospheric $Si_3N_4$ according to the prior casting method, the value is 27 Kg/mm$^2$, and in case of SKD 61, the value is 60 Kg/mm$^2$. On the other hand, in case of the atmospheric sintered α-sialonic ceramics according to the present invention, the value is 45 Kg/mm$^2$ which is approximately intermediary of and between the atmospheric $Si_3N_4$ group ceramics and SKD 61 according to the prior casting method, and in case of hot press α-sialonic ceramics, the value is 63 Kg/mm$^2$ which is the highest among the mold materials.

It has been therefore found that the a-sialonic ceramics according to the present invention is excellent in properties in which the fatigue strength of the repeating frequency of $1\times10^7$ at the normal temperature is higher than that of the atmospheric $Si_3N_4$ group ceramics and SKD 61 mold material according to the prior casting method.

Limit of use

The hot press α-sialonic ceramics mold and atmospheric sintered α-sialonic ceramics mold according to the present casting method and the atmospheric $Si_3N_4$ group ceramics mold and SKD 61 mold according to the prior casting method were actually mounted on the die casting machine, and various molten metal materials of aluminum alloy (7075), aluminum bronze casting (AlBC3), spherical graphite cast iron (FCD45) and stainless steel cast steel (SC13) were used. The test of durability was conducted under the experimental conditions given in Table 3 to find the relation between the pouring temperature of the molten metal material and the limit of use up to which various molds lasted. The mold is divided into three, i.e., a mold portion (a casting mold), a sleeve portion (an injection sleeve) and a core portion (a movable core). The pouring temperature using the aluminum alloy (7075) up to pouring temperature of 750° C. among the aforesaid molten metal materials and the limit of use up to which various molds lasted were compared which will be discussed below.

Figure 10:
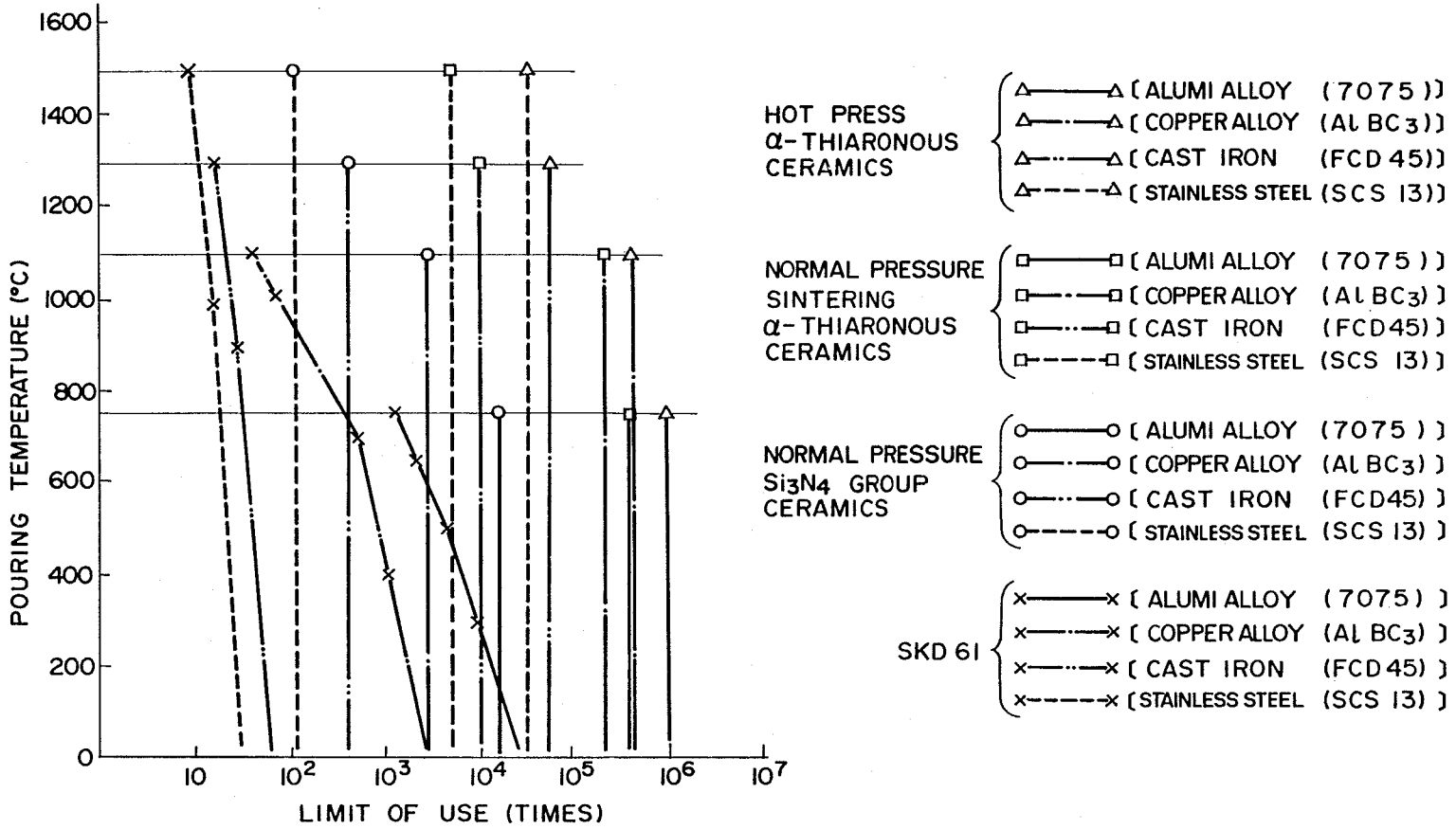
FIG. 10 shows a graph for comparison of the limit of use of the molds.

Casting shot was repeated in which aluminum alloy (7075) up to 750° C. of pouring temperature is injected and filled into the mold (so-called cavity) and further pressed and compressed to mold a molded article. Then, it has been found as will be apparent from the experimental results shown in FIGS. 4 and 10 that in the cast of the atmospheric $Si_3N_4$ group ceramics mold, the limit of use was up to 20000 times shot, and in the case of the SKD 61 mold, small cracks were made after 1400 times shot, and the limit of use reached after 5800 times. On the other hand, the atmospheric sintered α-sialonic ceramics mold according to the present casting method rarely found therein crack even after 200000 times shot and the shot was further continued up to 500000 times, and in the case of hot press α-sialonic ceramics mold, it lasted up to 1000000 times which further extended the limit of use.

Figure 11:
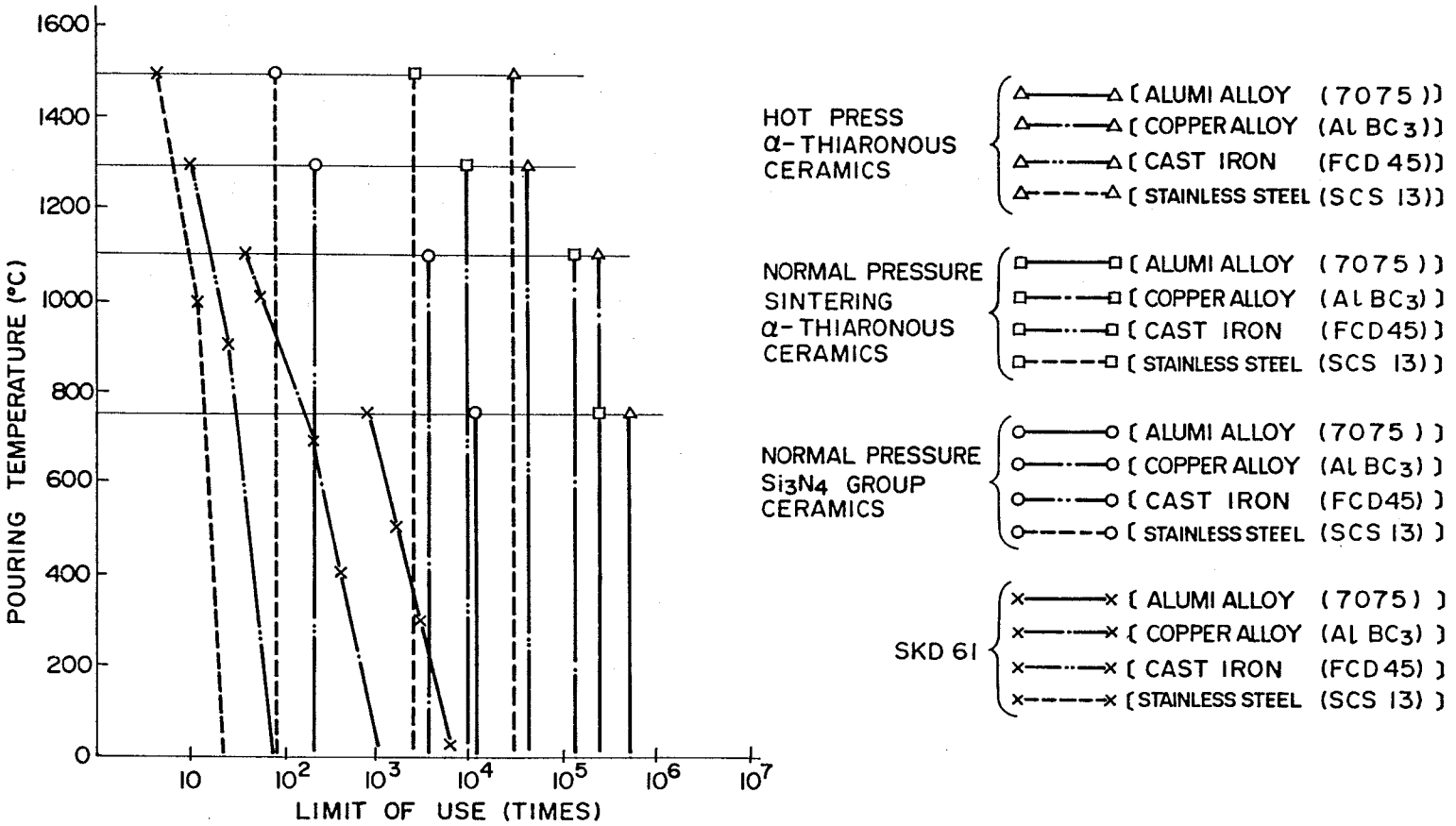
FIG. 11 is a graph for comparison of the limit of use of an injection sleeve and a core between the present casting method and the prior casting method.

In a similar way, an injection shot was repeated in which aluminum alloy (7075) up to pouring temperature of 750° C. was poured into the sleeve (so-called pot) to inject it under the injection force up to 10 tons. Then, as will be apparent from the experimental results shown in Table 4 and FIG. 11, the atmospheric sintered α-sialonic ceramics mold and hot press α-sialonic ceramics mold according to the present casting method is higher in limit of use than that of the atmospheric $Si_3N_4$ group ceramics mold and SKD 61 mold according to the prior casting method.

Accordingly, it became apparent that the α-sialonic ceramics mold according to the present casting method is excellent in properties showing the higher durable value of the limit of use than that of the atmospheric $Si_3N_4$ group ceramics mold and SKD 61 mold according to the prior casting method.

Heat retaining properties

Figure 12:
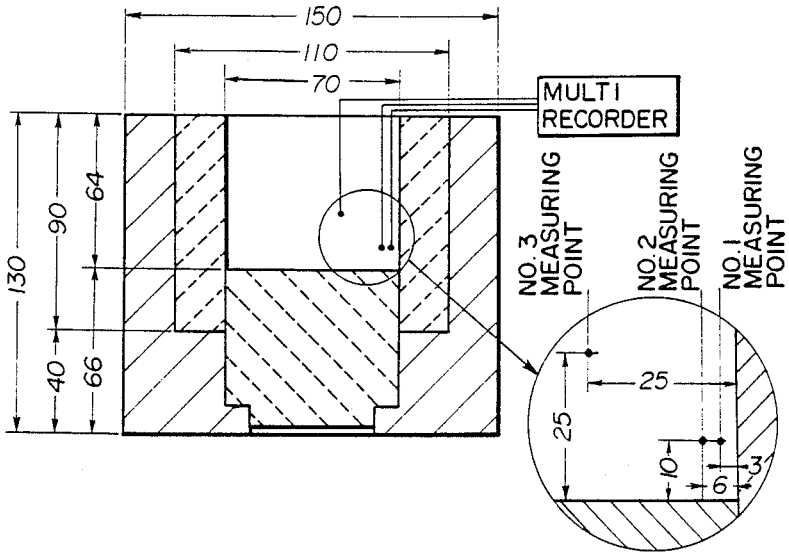
FIGS. 12 and 13 show pots used for testing the heat retaining properties between the present casting method and the prior casting method.
Figure 13:
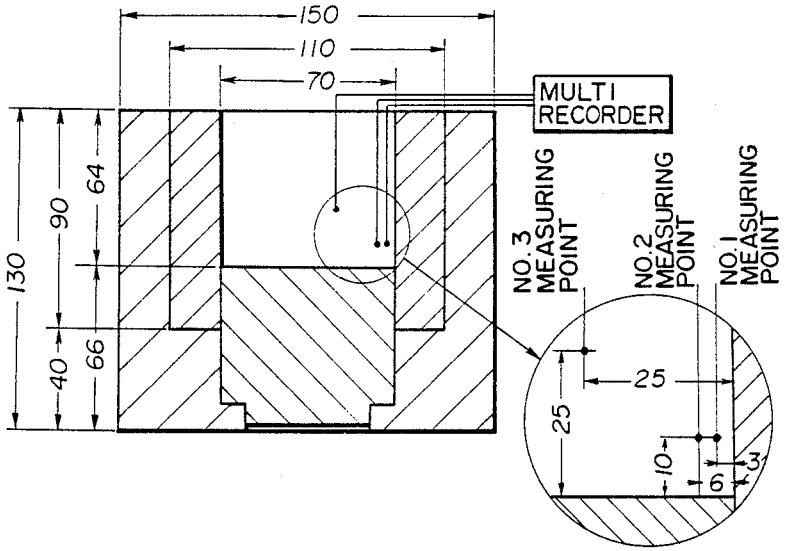
Figure 14:
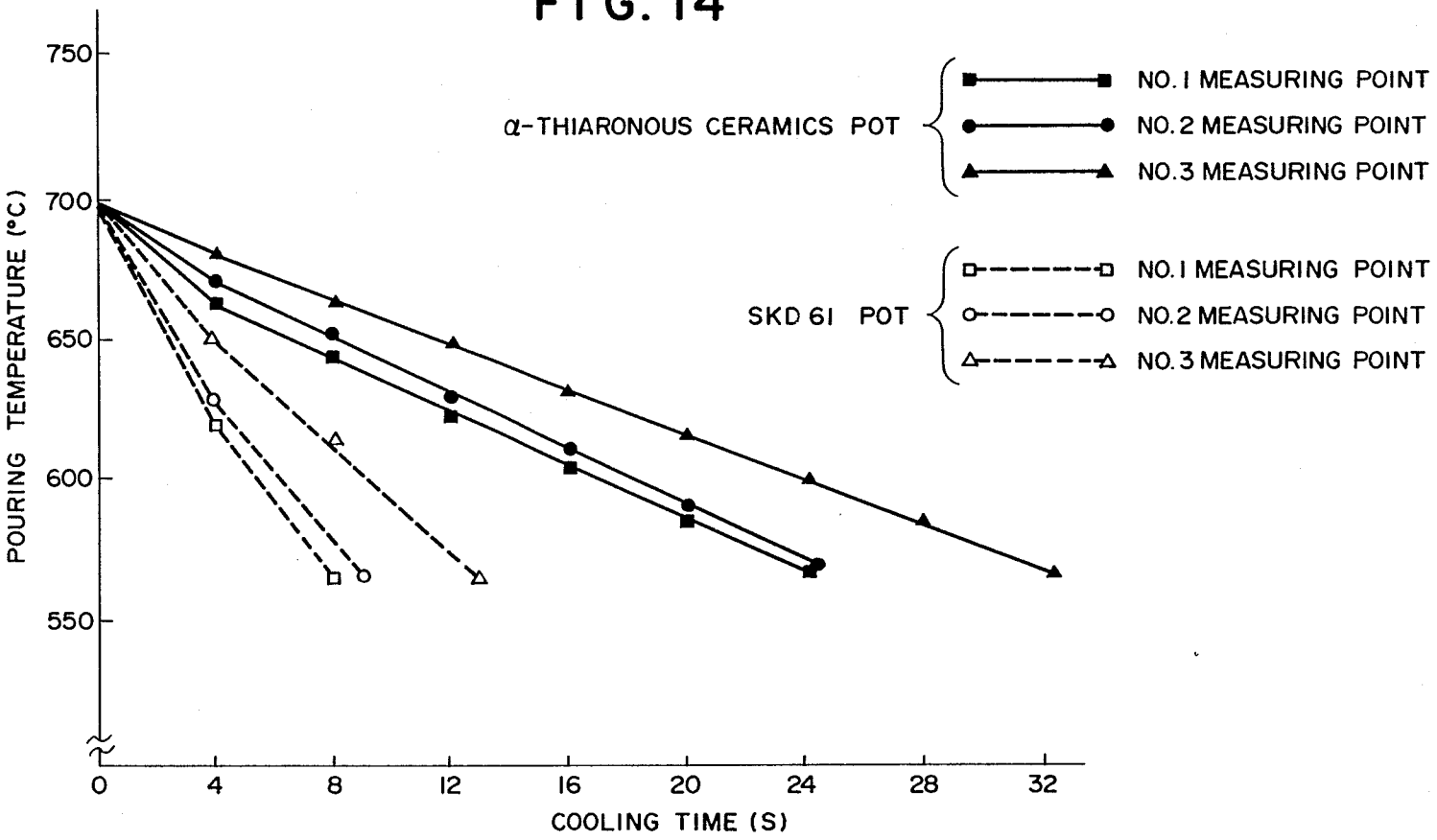
FIG. 14 is a graph for comparison of the heat retaining properties of the pots.
Figure 16A:
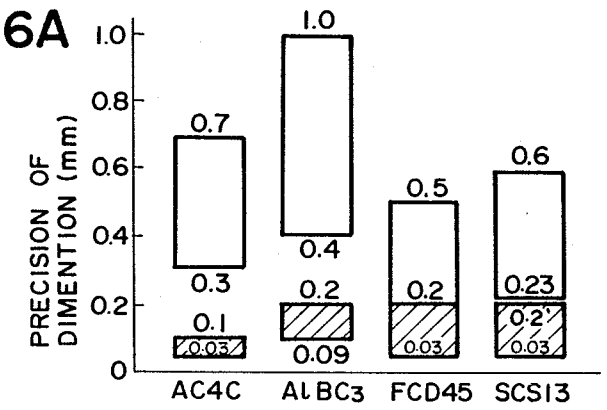
FIGS. 16 (*a*), (*b*), (*c*) and (*d*) are graphs for comparison of dimensions at the limit of tolerance of the molded article.
Figure 16B:
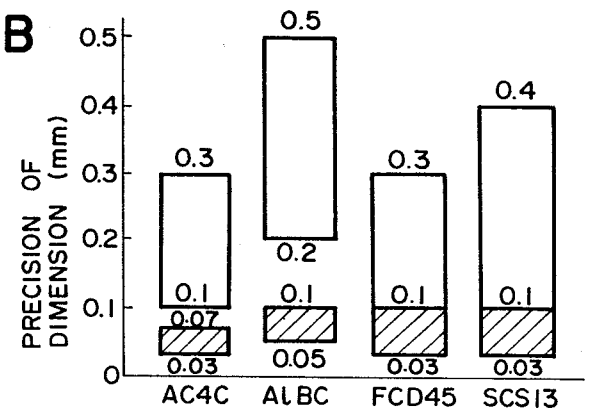
Figure 16C:
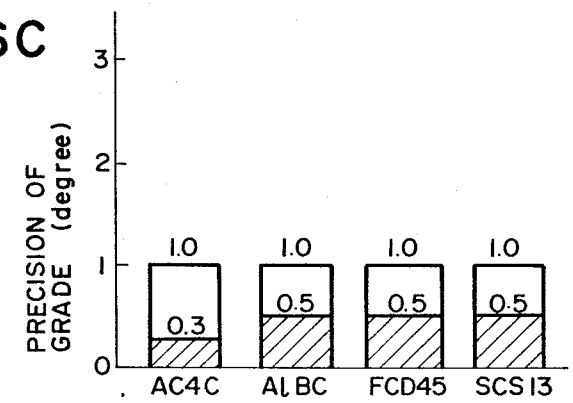
Figure 16D:
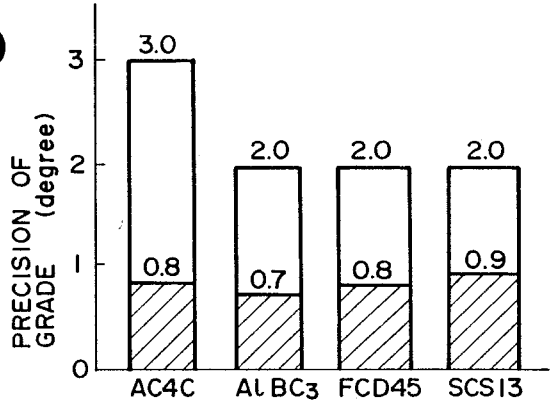

As shown in FIG. 12, into the atmospheric sintered α-sialonic ceramics pot of the present casting method using a combination of a sleeve having the outside diameter 110 m/m, inside diameter 70 m/m, and height 90 m/m and a tip (piston) having the outside diameter 70 m/m and height 66 m/m and into a SKD 61 pot of the conventional casting method having the same dimension and the same construction as shown in FIG. 13 are supplied aluminum (ADC 12) molten metal material up to pouring temperature of 700° C. No. 1 temperature sensor is arranged 3 mm from the wall surface and 10 mm from bottom surface (molten metal pushing surface) in the pot according to the prior and present casting methods, No. 2 temperature sensor arranged 6 mm from the wall surface and 10 mm from the bottom surface and No. 3 temperature sensor arranged 25 mm from the wall surface and 25 mm from the bottom surface. The temperature distributions of the molten metal material within the pot according to the prior and present casting methods were measured under the experimental conditions given in Table 5 and the results obtained therefrom are shown in FIG. 14.

In the case of the SKD 61 pot according to the prior casting method, the temperature dropping speeds (cooling speeds) of measurements from the pouring temperature 700° C. at the time of pouring molten metal to the solidification starting temperature 658° C. are 16.5° C./sec., 14.7° C./sec. and 10.2° C./sec. in the measurement Nos. 1, 2 and 3, respectively, as shown by the cooling curve from the time when molten metal is supplied to the starting of solidification, a difference in temperature dropping speed between the measurement Nos. 1 and 3 being approximately 6° C./sec. On the other hand, in the case of the atmospheric sintered α-sialonic ceramics pot according to the present casting method, the values are 5.5° C./sec., 5.4° C./sec. and 4.1° C./sec. in the measurement Nos. 1, 2 and 3, respectively, a difference in temperature dropping speed between the measurement Nos. 1 and 3 being only approximately 1° C./sec.

The values of the above-described measurements are the cooling time at which the measurement No. 1 drops down to a solidification starting temperature; that is, in the case of the conventional casting method, the values of the measurements on the 8 sec line, and in the case of the present casting method, the values of the measurements on the 24 sec line.

Accordingly, within the SKD61 pot of the conventional casting method, a solidified film is quickly formed to easily produce a solidified piece since a difference in temperature dropping speed between the measurement No. 1 and the measurement No. 3 is great. On the other hand, within the atmospheric α-sialonic ceramics pot of the present casting method, there provides excellent thermal properties having high heat retaining properties free from formation of a solidified piece since a difference in temperature dropping speed between the measurement Nos. 1 and 3 is rarely present to slowly form a solidified film.

As will be apparent from the aforesaid experimental values, the heat retaining properties of the ceramics material are excellent, and therefore the injection pressure can be reduced from 1/5 to 1/10 in terms of the fact that in prior art, a solidification prevention cannot be achieved, and a half solid solution has been forcibly introduced.

Next, comparison will be made of the strength, precision of dimension and grade, crystal structure (crystal grain size) and bulk density between articles cast by the present casting method and articles cast by the conventional casting method.

Strength

Cast articles of the present casting method and those of the prior casting method, said articles being formed of various molten metal materials, were subjected to testing of tensile strength, elongation, and hardness under the experimental conditions given in Table 6, and the results obtained from such experiments are shown in Tables 7 and 8. Table 8 shows the ratio of the experimental average value of the present casting method to that of the prior casting method of various molten metal materials in the state of "as molded".

As will be apparent from Tables 7 and 8, the experimental values of the tensile strength, elongation and hardness of molded articles according to the present casting method are higher than those of the prior casting method. The calculation formula of ratio in Table 8 is given by:

$$\text{Ratio}_{(p,p')} = \frac{\text{Average value } (Y,Y') \text{ of experimental values of the present casting method}}{\text{Average value } (X,X') \text{ of experimental values of the prior casting method}} \times 100\%$$

where

P, Y, X: Tensile strength p', Y', X': Hardness

It has been thus found that the strength of the molded article according to the present casting method has excellent mechanical properties which indicates the value of strength higher than that of the cast article according to the prior casting method.

Precision of dimension and grade

Various molten metal materials of aluminum alloy (AC4C), aluminum bronze casting (AlBC3), spherical graphite cast iron (FCD45) and stainless steel cast steel (3) are injected and filled into the mold (α-sialonic ceramics mold) of the present casting method and the mold (metal mold) of the prior casting method to cast articles. Precisions of length dimension (in case of 60 mm), thickness dimension (in case of 8 mm) and inner and outer drafts (in case of 10 mm) were measured, and the comparison of precision of dimension and grade thereof is shown in Table 9, FIG. 16 (*a*), (*b*), (*c*and (*d*) and Table 10. Table 10 shows the ratio of the average value of the precision 6*f* dimension and grade according to the present invention to that of the prior casting method.

As will be apparent from FIG. 9 and FIG. 16 (*a*), (*b*), (*c*) and (*d*), the followings can be found as to the length, thickness, and inner and outer drafts of molded articles according to the present casting method to those of the prior casting method. In FIG. 16 (*a*), (*b*), (*c*) and (*d*), the blank portion indicates maximum and minimum value of precision to dimension and grade of molded articles according to the prior casting method, and the oblique line portion indicates those of the present casting method.

(1) Length

AC4C . . . Approx. 1/7; AlBC3 . . . Approx. 1/5; FCD45 . . . Approx. ½; SCS 13 . . . Approx. ½

(2) Thickness

AC4C . . . Approx. 1/5; AlBC3 . . . Approx. 1/6; FCD45 . . . Approx. ⅓; SCS13 . . . Approx. ¼

(3) Outer Draft

AC4C . . . Approx. ⅓; AlBC3 . . . Approx. ½; FCD45 . . . Approx. ½; SCS13 . . . ½

(4) Inner Draft

AC4C . . . Approx. ¼; AlBC3 . . . Approx. ⅓; FCD45 . . . Approx. ½; SCS13 . . . Approx. ½

It has thus been found that when seeing the dimensional precision of the thickness from Table 10, molded articles molded by the mold (α-sialonic ceramics mold) of the present casting method have the precision higher 20% to 30% than that of cast articles cast by the mold (metal mold) of the prior casting method.

Crystal structure and bulk density

Figure 17A:
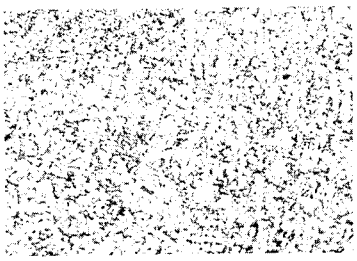
FIGS. 17 (*a*) and (*b*) to FIGS. 23 (*a*) and (*b*) show crystal compositions of molded articles according to the present casting method.
Figure 17B:
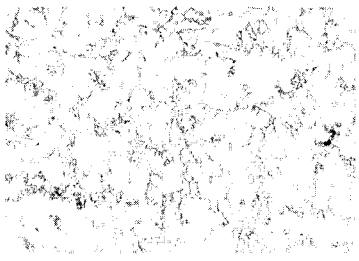

Crystal structures in the molded articles of the present casting method and molded articles of the prior casting method formed of various materials of aluminum alloy ADC12, 7075, AC4C, copper alloy: YBsC3, AlBC3, spherical graphite cast iron: FCD45, stainless steel cast steel: SCS13 are shown in FIG. 17 (*a*), (*b*) to FIG. 31 (*a*), (*b*). Here, FIG. 17 (*a*), (*b*) and FIG. 23 (*a*), (*b*) show the crystal structures of the molded articles according to the present casting method, and FIG. 24 (*a*), (*b*) to FIG. 31 (*a*), (*b*) show the crystal structures of the molded articles according to the prior casting method, the (a) being the crystal structure of which magnification is 100 times, the (b) being the crystal structure of which magnification is 400 times.

Figure 18A:
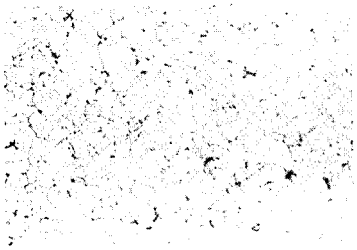
Figure 18B:
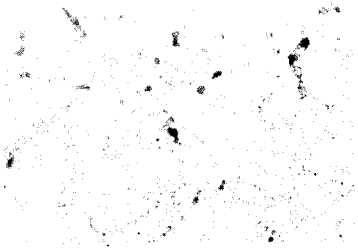
Figure 19A:
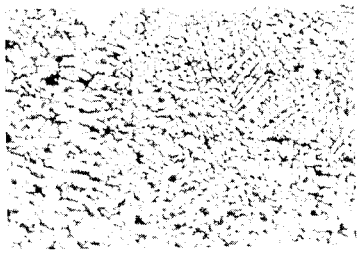
Figure 19B:
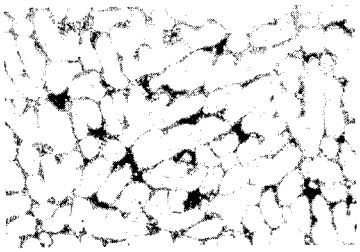
Figure 20A:
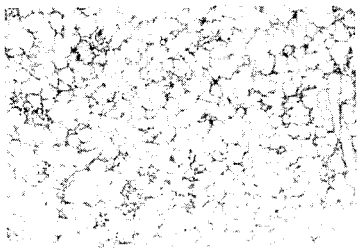
Figure 20B:
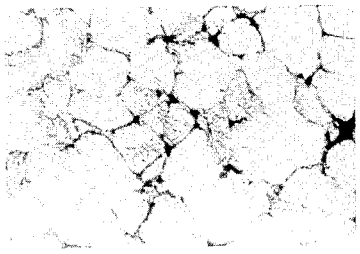
Figure 21A:
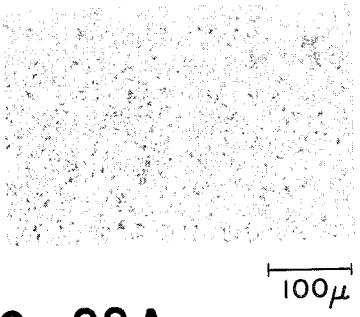
Figure 21B:
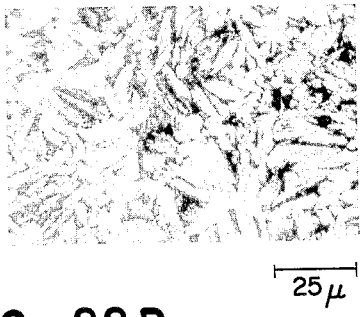
Figure 22A:
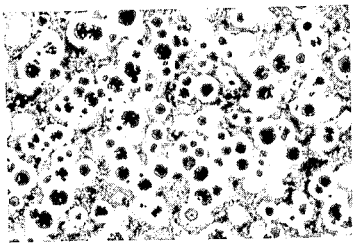
Figure 22B:
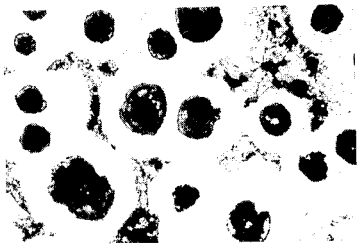
Figure 23A:
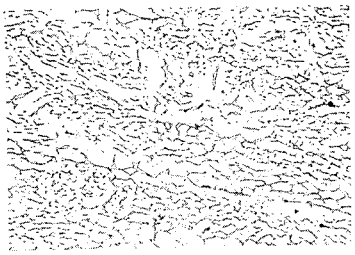
Figure 23B:
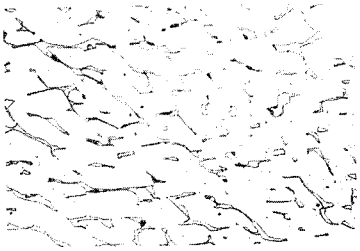
Figure 24A:
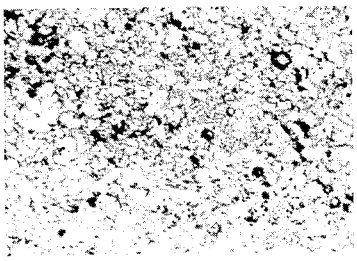
FIGS. 24 (*a*) and (*b*) to FIGS. 31 (*a*) and (*b*) show crystal compositions of molded articles according to the prior casting method.
Figure 24B:
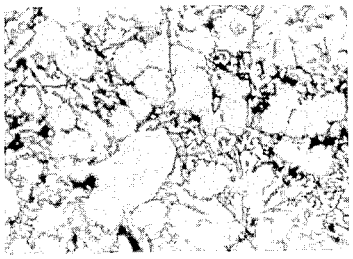
Figure 25A:
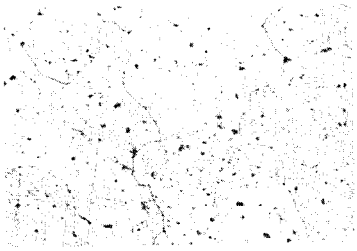
Figure 25B:
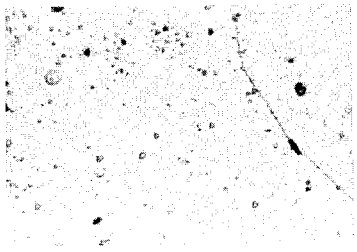
Figure 26A:
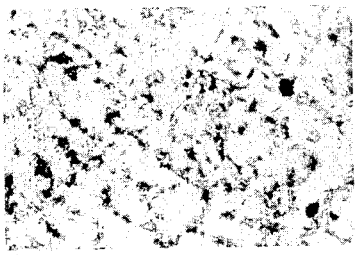
Figure 26B:
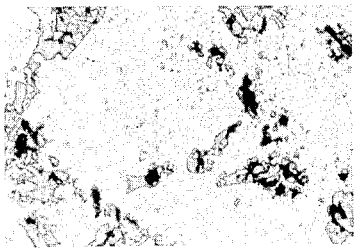
Figure 27A:
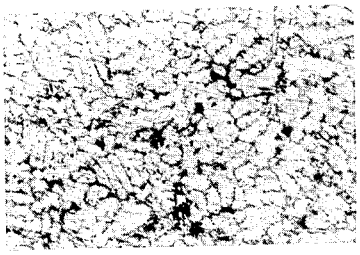
Figure 27B:
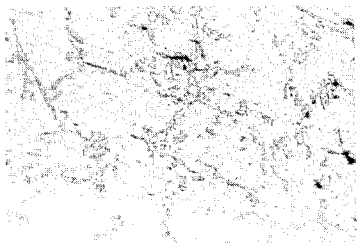
Figure 28A:
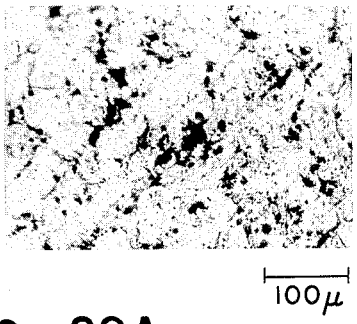
Figure 28B:
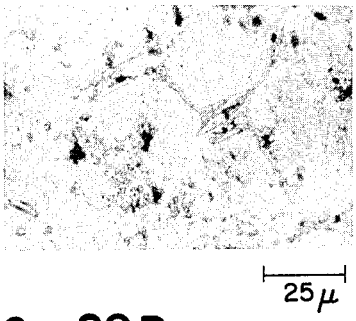
Figure 29A:
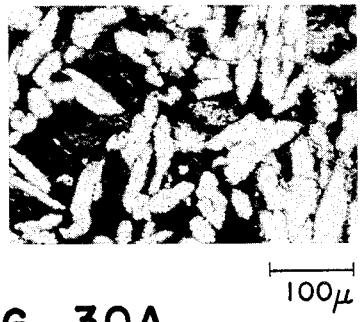
Figure 29B:
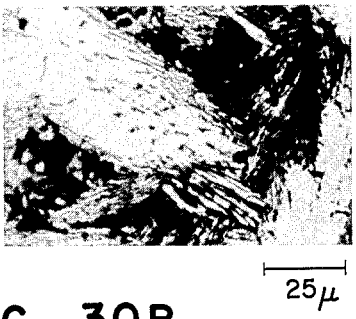
Figure 30A:
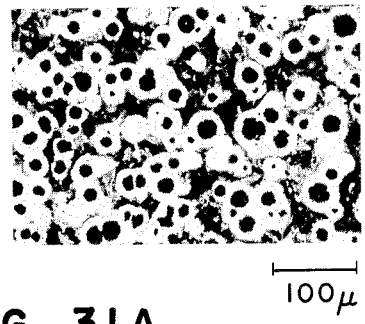
Figure 30B:
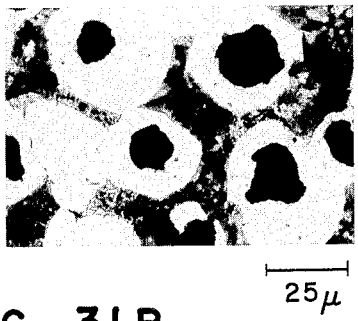
Figure 31A:
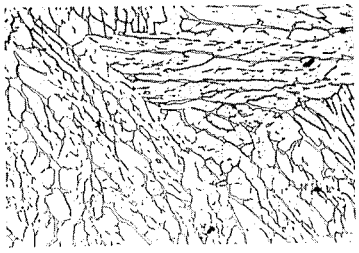
Figure 31B:
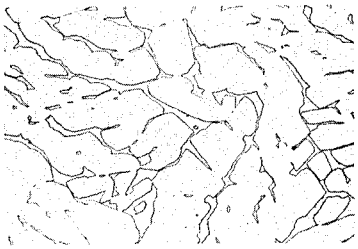

In these figures showing crystal structures, FIG. 17 (*a*) (*b*) and FIG. 24 (*a*) (*b*) are for ADC12 molded articles, FIG. 18 (*a*) (*b*) and FIG. 25 (*a*) (*b*) for 7075 molded articles, FIG. 19(*a*)(*b*), FIG. 26 (*a*)(*b*) and FIG. 27(*a*)(*b*) for AC4C molded articles, FIG. 20 (*a*) (*b*) and FIG. 28 (*a*) (*b*) for YBsC3 molded articles, FIG. 21 (*a*) (*b*) and FIG. 29 (*a*) (*b*) for AlBC3 molded articles, FIG. 22(*a*)(*b*) and FIG. 30 (*a*) (*b*) for FCD45 molded articles, and FIG. 23 (*a*) (*b*) and FIG. 31 (*a*) (*b*) for SCSl3 cast articles. Molded articles shown in FIG. 24(*a*) (*b*)were molded by the die casting, molded articles in FIG. 25 (*a*) (*b*) by the elongated material (extrusion pullout rod), cast articles in FIG. 26 (*a*) (*b*) and FIG. 28 (*a*) (*b*) by the sand mold casting, cast articles in FIG. 27 (*a*) (*b*) and FIG. 29 (*a*) (*b*) by the metal mold casting, and cast articles in FIG. 30 (*a*) (*b*) and FIG. 31 (*a*) (*b*) by the lost wax, respectively.

As will be apparent from these figures, the cast articles according to the present casting method are finer or denser in crystal structure than those of the prior casting method.

Comparing the grain sizes, as for example of the AC4C molded articles, in the prior casting method, the cast article by the sand mold has approximately 57$\mu$, the cast article by the metal mold has approximately 20$\mu$, which is the size about $\frac{1}{3}$ of the cast article by the sand mold. In the cast article of the present casting method, the crystal grain size is approximately 10 $\mu$, which is about 1/6 of the cast article by the sand mold.

Next, the bulk density was measured to find the fineness and the measured results are given in Table 10.

As will be apparent from Table 10, the bulk density of the molded article according to the present casting method is the value about 10% of that of the prior casting method, which is formed into a super fined crystal structure having excellent mechanical properties.

The calculation formula for the bulk density is given by:

$$\text{Bulk density} = \frac{\text{Weight measured in air}}{\text{Weight measured in air} - \text{weight measured in water (20°)}}$$

Here, the bulk density was expressed by the value obtained by subjecting specimen to paraffining, then dividing the weight measured in air by a difference in weight measured in air and in water (20° C.).

As described above, according to the present invention, one or both of a fixed mold or a movable mold, which serves as a casting mold, and a core incorporated into one or both the molds are formed of high strength ceramics, and a movable hob for pressurizing molten metal injected and filled into both the fixed and movable molds is formed of high strength ceramics. Therefore, there can provide a mold construction which is excellent in mechanical characteristics such as strength, hardness, breaking toughness and the like with respect to molten metal having a high temperature from 600° to 1650° C. or so and having durability and pressure resistance enough to withstand high temperature thermal shock and high pressure, thus providing a greatly durable molding mold for use at high temperatures.

In addition, one or both of a fixed mold and a movable mold, which serves as a casting mold, are in the form of a high strength ceramics mold, and therefore a rapid increase in cooling speed within the mold is relieved. Accordingly, the range of controlling the cooling speed by the cooling mechanism is extended to facilitate the control operation, particularly fine control. The temperature distribution within the mold may be easily controlled to the cooling speed according to the shape and material of molded articles. Moreover, gases (air) caught into the molding portion after the mold is closed may be promptly discharged by the suction mechanism approximately simultaneously with the starting of pouring of molten metal, and produced gases produced in thick-wall portion or the like where much heat is present when molten metal is solidified may be promptly discharged outside the molding portion by the operation of the gas vent mechanism (backward movement through a predetermined amount) approximately simultaneously with the pressurization of the interior of the molding portion.

Thereby, the super fineness of the crystal structure free of cavities or blowholes may be promoted to cast and mold molded articles of high precision and high quality having great mechanical properties such as high strength, hardness and the like.

Moreover, since an injection sleeve and a piston slidably inserted therein are formed of high strength ceramics, there is rarely present a difference in temperature dropping speed of molten metal supplied into the injection sleeve (pot) between the surface portion in the neighbourhood of the inner walls within the sleeve and the center in the neighbourhood of the axis. Thereby a solidified film hardly occurs and therefore a solidified piece is not possibly caught into the molding mold.

Furthermore, since fixed platens spaced apart from each other, tie bars mounted over and between both the fixed platens and a movable plate with a movable mold mounted movably forward and backward on the tie bars are provided with cooling mechanisms, respectively, they are free from strains or the like caused by thermal shock such as radiant heat from the mold. Whereby, no possible load stress is applied when the movable mold is moved forward and backward during closing and opening the mold, and the movable mold may be smoothly moved forward and backward. Particularly, adjustment of the movable mold to the fixed mold may be achieved with high accuracy.

TABLE 1

Figure 6:
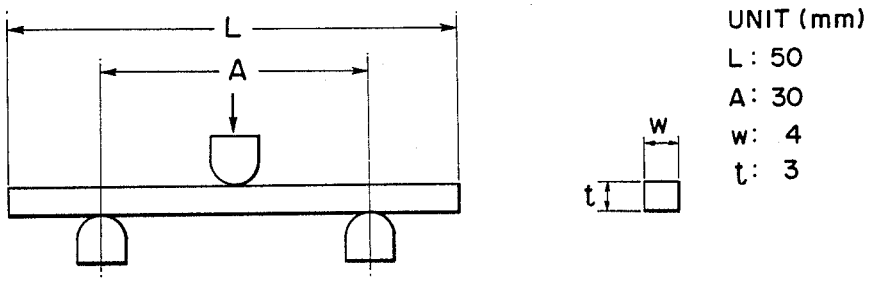
FIG. 6 shows a test piece used for testing a bending strength of molds for the present casting method and prior casting method.

| Item | Testing Method | Tester | Shape of Test Piece | Conditions |
|---|---|---|---|---|
| Bending Strength | According to JISR 1601 "Bending Strength Testing Method of fine ceramics" | Universal Material Tester of SHIMAZU make | Shown in FIG. 6 | Moving speed of cross-head: 0.5 mm/min. Span distance: 30 mm |

TABLE 1-continued

| Item | Testing Method | Tester | Shape of Test Piece | Conditions |
|---|---|---|---|---|
| Tensile Strength | According to JISZ 2241 "Metallic Material Tension Testing Method" | High-temperature tension tester of SHIMAZU make | According to JIS No. 4 test piece | 3-point bending method Tensile speed: 5 mm/min. |

TABLE 2

Figure 8:
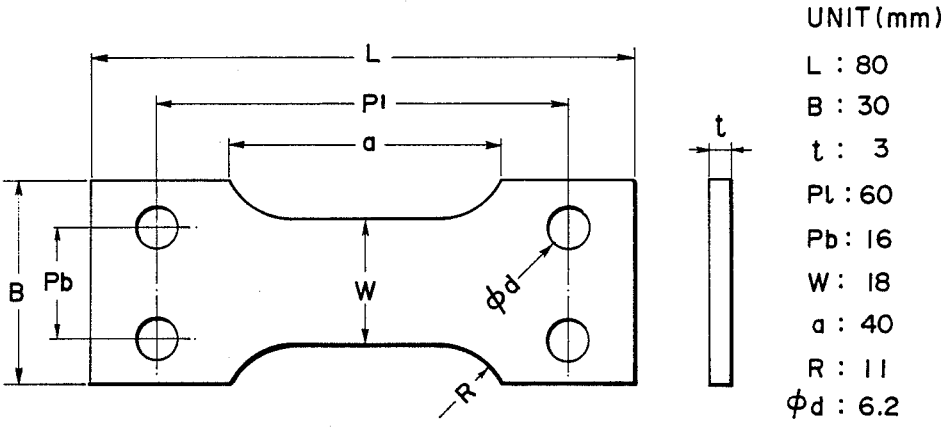
FIG. 8 shows a test piece used for testing a fatigue strength.

| Item | Mold Material | Tester | Shape of Test Piece | Conditions |
|---|---|---|---|---|
| Stress Amplitude and Repeating Number | Ceramics and SKD61 | NISHIHARA plane bending fatigue tester | As shown in FIG. 8 | Atmosphere: room temp. Method: Complete alternate vibration Repeating Speed: 40 HZ Trancate repeating number: $1 \times 10^7$ |

TABLE 3

| Mold | | | | | Using Material | | | Pressure Setting Conditions of Molding & Working Machine | |
|---|---|---|---|---|---|---|---|---|---|
| Name | | Dimension (mm) | | | Name | Pouring Temp. (°C.) | Melting Temp. (°C.) | Injection Force (t) | Clamping Force (t) |
| Mold portion (molding) | a | Out. Dia. ϕ 148 | Height 86 | | Aluminum alloy 7075 | 750 | | | |
| | b | Length 300 | Width 170 | Height 100 | Aluminum bronze casting (copper alloy) AlBC3 | 1100 | | | |
| Sleeve portion (injection sleeve) | | Out. Dia. ϕ 94 | In Dia. ϕ 40 | Height 320 | Spherical graphite cast iron (cast iron) FCD45 | 1340 | (In case of 3.5% C) 1290 | 10 | 80 |
| Core portion (movable core) | | Out. Dia. ϕ 17.3 | Length 118.4 | | Stainless steel cast steel (cast steel) SCS13 | 1550 | (In case 18% Cr 8% Ni) 1443 | | |

TABLE 4

| Mold | Material of Mold | Material Used | Pouring Temp. (°C.) | Limit of Use (Times) |
|---|---|---|---|---|
| Mold portion (main mold) | Hot press α-sialonic ceramics (present casting method) | 7075 | 750 | Lasted up to 1000000 times |
| | | AlBC3 | 1100 | Lasted 500000 times |
| | | FCD45 | 1340 | Lasted 60000 times |
| | | SCS13 | 1550 | Lasted 40000 times |
| | Atmospheric sintered α-sialonic ceramics (present casting method) | 7075 | 750 | Lasted 500000 times |
| | | AlBC3 | 1100 | Lasted 300000 times |
| | | FCD45 | 1340 | Lasted 8700 times |
| | | SCS13 | 1550 | Lasted 5000 times |
| | Atmospheric $Si_3N_4$ group ceramics (prior casting method) | 7075 | 750 | Lasted 20000 times |
| | | AlBC3 | 1100 | Lasted 5000 times |
| | | FCD45 | 1340 | Lasted 500 times |
| | | SCS13 | 1550 | Lasted 100 times |
| | SKD61 (Prior casting method) | 7075 | 750 | Small crack in 1400 times, large crack in 5800 times, and mold removed. |
| | | AlBC3 | 1100 | Small crack in 50 times, large crack in 600 times, and mold removed. |
| | | FCD45 | 1340 | Small crack in 20 times, large crack in 40 times, and mold removed. |
| | | SCS13 | 1550 | Small crack in 10 times, large crack in 20 times, and mold removed. |
| Sleeve portion (injection sleeve) and Core portion (movable core) | Hot press α-sialonic ceramics (present casting method) | 7075 | 750 | Lasted up to 600000 times |
| | | AlBC3 | 1100 | Lasted 300000 times |
| | | FCD45 | 1340 | Lasted 50000 times |
| | | SCS13 | 1550 | Lasted 30000 times |

TABLE 4-continued

| Mold | Material of Mold | Material Used | Pouring Temp. (°C.) | Limit of Use (Times) |
|---|---|---|---|---|
| | Atmospheric sintered α-sialonic ceramics (present casting method) | 7075 | 750 | Lasted 300000 times |
| | | AlBC3 | 1100 | Lasted 150000 times |
| | | FCD45 | 1340 | Lasted 10000 times |
| | | SCS13 | 1550 | Lasted 3000 times |
| | Atmospheric $Si_3N_4$ group ceramics (prior casting method) | 7075 | 750 | Lasted 10000 times |
| | | AlBC3 | 1100 | Lasted 5000 times |
| | | FCD45 | 1340 | Lasted 300 times |
| | | SCS13 | 1550 | Lasted 100 times |
| | SKD61 (Prior casting method) | 7075 | 750 | Small crack in 800 times, large crack in 2000 times, and mold removed. |
| | | AlBC3 | 1100 | Small crack in 50 times, large crack in 300 times, and mold removed. |
| | | FCD45 | 1340 | Small crack in 10 times, large crack in 30 times, and mold removed. |
| | | SCS13 | 1550 | Small crack in 5 times, large crack in 10 times, and mold removed. |

TABLE 5

| | Material and Shape of Pot | | | | | | | Range of Solidification (°C.) | |
|---|---|---|---|---|---|---|---|---|---|
| | Prior Casting Method | | Present Casting Method | | | | | | |
| Type of furnace | Sleeve SKD61 | Tip SKD61 | Sleeve α-sialonic ceramics | Tip α-sialonic ceramics | Temp. Sensor (Material & Shape) | Measuring instrument | Pour. Temp. (°C.) | Solidification start | Solidification termination |
| 8KVA round electric furnace | OD 110 m/m ID 70 m/m Height 90 m/m | *OD 70 m/m Height 66 m/m | OD 110 m/m ID 70 m/m Height 90 m/m | OD 70 m/m Height 66 m/m | 0.6 m/m × 200 m/m CA wire | Multirecorder 3-point intermittent type (MC6733) | 700 | 568 | 515 |

Note:
*OD: Outside Diameter
ID: Inside diameter

TABLE 6

Figure 15:
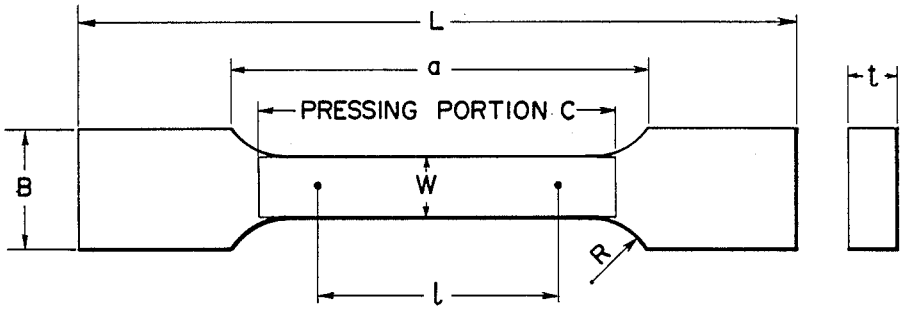
FIG. 15 shows a test piece used for testing the tensile strength and elongation of a molded article obtained by the present casting method.

| Item | Testing Method | Tester | Shape of Test Piece | Conditions |
|---|---|---|---|---|
| Tensile strength and elongation | According to JISZ2241 "Method for testing tension of metal material" | Universal material tester of TOKYO SHOKI make | Test piece of the present casting method is shown in FIG. 15, and test piece of prior casting method is in accordance with JIS No. 4 | Tension speed: 6 mm/min |
| Hardness (Brinel hardness) | According to JISZ2243 "Method for testing Brinel hardness" | Brinel hardness tester of TOKYO SHOKI make | Measurement of parallel portion of a surface by various testing data | Test load 500 kg *3000 kg Indentor dia. ϕ 10 mm 10 Retaining time 30 sec. 30 |

*FCD 45, and SCS 13

TABLE 7

| | | Molded Articles By Prior Casting Method | | | | | |
|---|---|---|---|---|---|---|---|
| | | As Molded | | | After Heat Treatment | | |
| Material | Casting | Tensile strength Kgf/mm² | Elongation % | Hardness HB | Tensile strength Kgf/mm² | Elongation % | Hardness HB |
| 1 ADC12 (Aluminum alloy die cast 12 kinds) | Diecast | 15–27 | 0.7–1.9 | 60–70 | — | — | — |
| 2 7075 (Aluminum alloy) | Elongating mat. pull-out rod | — | — | — | 64–68 | 7–9 | 130–170 |
| 3 AC4C (Aluminum alloy casting 4 kinds) | Sand mold | 11–17 | 1–5 | 53–60 | 20–26 | 1–7 | 76–82 |
| | Metal mold | 19–23 | 4–14 | 56–70 | 25–30 | 5–15 | 85–91 |
| 4 YBsC3 (Brass | Sand mold | 30–35 | 20–25 | 60–80 | — | — | — |

TABLE 7-continued

| | | | | | | | | |
|---|---|---|---|---|---|---|---|---|
| | casting 3 kinds) | | | | | | | |
| 5 | AlBC3 (Aluminum bronze casting 3 kinds) | Sand mold | 61–65 | 26–30 | 160–167 | — | — | — |
| 6 | FCD45 (Spherical graphite cast iron 2 kinds) | Lost wax | 46 | 14 | 197 | — | — | — |
| 7 | SCS13 (Stainless steel cast steel 13 kinds) | Lost wax | 47 | 32 | 180 | — | — | — |

| | | Molded Articles By Present Casting Method | | | | | | |
|---|---|---|---|---|---|---|---|---|
| | | As Molded | | | After Heat Treatment | | | |
| | Material | Tensile strength Kgf/mm$^2$ | Elongation % | Hardness HB | Tensile strength Kgf/mm$^2$ | Elongation % | Hardness HB | Remarks |
| 1 | ADC12 (Aluminum alloy die cast 12 kinds) | 27–29 | 2–5 | 70–80 | — | — | — | |
| 2 | 7075 (Aluminum alloy) | 23–26 | 4–8 | 85–95 | 54–58 | 1–5 | 120–160 | Heat treatment effected at $T_6$ |
| 3 | AC4C (Aluminum alloy casting 4 kinds) | 22–25 | 5–7 | 69–76 | 32–37 | 6–11 | 95–106 | Heat treatment effected at $T_6$ |
| 4 | YBsC3 (Brass casting 3 kinds) | 35–43 | 10–20 | 95–110 | — | — | — | |
| 5 | AlBC3 (Aluminum bronze casting 3 kinds) | 67–73 | 2–6 | 180–190 | — | — | — | |
| 6 | FCD45 (Spherical graphite cast iron 2 kinds) | 50 | 11 | 220 | — | — | — | |
| 7 | SCS13 (Stainless steel cast steel 13 kinds) | 51 | 34 | 185 | — | — | — | |

TABLE 8

| | Tensile Strength of Molded Articles BY Prior Casting Method | | Average Value of Tensile Strength of Molded Articles | | Hardness of Molded Articles By Prior Casting Method (HB) | | Average Value of Hardness of Molded | |
|---|---|---|---|---|---|---|---|---|
| | Casting Method | Ave. Value of Tensile Strength (Kgf/mm$^2$)(X) | By Present Casting Method (Kgf/mm$^2$)(Y) | Ratio (p) $p = \frac{Y}{X} \times 100\%$ | Casting | Ave. Value of Hardness (X') | Articles by Present Casting Method (Y') | Ratio (p') $p' = \frac{Y'}{X'} \times 100\%$ |
| ADC12 | Diecast | 21 | 28 | 133 | Diecast | 65 | 75 | 115.4 |
| 7075 | Elon-gated material (pull-out rod) | 66 | 56 | 84.8 | Elon-gated material (Pull-out rod) | 150 | 140 | 93.3 |
| AC4C | Sand mold casting | 14 | 23.5 | 167.8 | Sand mold casting | 56.5 | 73 | 129.2 |
| | Metal mold casting | 21 | 23.5 | 111.9 | Metal mold casting | 63 | 73 | 115.9 |
| YBsC3 | Sand | 32.5 | 39 | 120 | Sand | 70 | 102.5 | 146.4 |

TABLE 8-continued

| | Tensile Strength of Molded Articles BY Prior Casting Method | | Average Value of Tensile Strength of Molded Articles | | Hardness of Molded Articles By Prior Casting Method (HB) | | Average Value of Hardness of Molded | |
|---|---|---|---|---|---|---|---|---|
| | Casting Method | Ave. Value of Tensile Strength ($Kgf/mm^2$)(X) | By Present Casting Method ($Kgf/mm^2$)(Y) | Ratio (p) $p = \frac{Y}{X} \times 100\%$ | Casting | Ave. Value of Hardness (X') | Articles by Present Casting Method (Y') | Ratio (p') $p' = \frac{Y'}{X'} \times 100\%$ |
| A1BC3 | mold casting Sand mold casting | 63 | 70 | 111 | mold casting Sand mold casting | 163.5 | 185 | 113.1 |
| FCD45 | Lost wax | 46 | 50 | 108.7 | Lost wax | 197 | 220 | 111.7 |
| SCS13 | Lost wax | 47 | 51 | 108.5 | Lost wax | 180 | 185 | 102.8 |

TABLE 9

| | 1. Lengthwise (In case of 60 mm) | | | | | | | |
|---|---|---|---|---|---|---|---|---|
| | Material of Mold (mm) | | | | | | | |
| | Prior Casting Mold (Metal Mold) | | | | Present Casting Mold (α-sialonic ceramics mold) | | | |
| | Material | | | | | | | |
| | AC4C | AlBC3 | *FCD45 | *SCS13 | AC4C | AlBC3 | FCD45 | SCS13 |
| Precision of dimension | 0.3–0.7 | 0.4–1.0 | 0.2–0.5 | 0.2–0.6 | 0.03–0.1 | 0.09–0.20 | 0.03–0.20 | 0.03–0.23 |

| | 2. Thickness-wise (In case of 8 mm) | | | | | | | |
|---|---|---|---|---|---|---|---|---|
| | Material of Mold (mm) | | | | | | | |
| | Prior Casting Mold (Metal Mold) | | | | Present Casting Mold (α-sialonic ceramics mold) | | | |
| | Material | | | | | | | |
| | AC4C | AlBC3 | *FCD45 | *SCS13 | AC4C | AlBC3 | FCD45 | SCS13 |
| Precision of dimension | 0.1–0.3 | 0.2–0.5 | 0.1–0.3 | 0.1–0.4 | 0.03–0.07 | 0.05–0.10 | 0.03–0.10 | 0.03–0.10 |

| | 3. Draft (In case of 10 mm) | | | | | | | | | | | | | | | |
|---|---|---|---|---|---|---|---|---|---|---|---|---|---|---|---|---|
| | Material of Mold (degree) | | | | | | | | | | | | | | | |
| | Prior Casting Mold (Metal Mold) | | | | | | | | Present Casting Mold (α-sialonic ceramics mold) | | | | | | | |
| | Material | | | | | | | | | | | | | | | |
| | AC4C | | AlBC3 | | *FCD45 | | *SCS13 | | AC4C | | AlBC3 | | FCD45 | | SCS13 | |
| | Outer draft | Inner draft | Outer draft | Inner draft | Outer draft | Inner draft | Outer draft | Inner draft | Outer draft | Inner draft | Outer draft | Inner draft | Outer draft | Inner draft | Outer draft | Inner draft |
| Precision of grade | 1 | 3 | 1 | 2 | 1 | 2 | 1 | 2 | 0.3 | 0.8 | 0.5 | 0.7 | 0.5 | 0.8 | 0.5 | 0.9 |

(*FCD45, SCS13: forging die)

TABLE 10

| Item | Material | Average Value (X') of precision of dimension and grade of Prior Casting Mold (Metal Mold) | Average Value (Y') of precision of dimension and grade of Present Casting Mold (α-sialonic ceramics mold) | Ratio (P') $P' = \frac{Y'}{X'} \times 100\%$ |
|---|---|---|---|---|
| Length | AC4C | 0.50 | 0.065 | 13.0 |
| | AlBC3 | 0.70 | 0.145 | 20.7 |
| | FCD45 | 0.35 | 0.115 | 32.9 |
| | SCS13 | 0.40 | 0.130 | 32.5 |
| Wall-thickness | AC4C | 0.20 | 0.05 | 25.0 |
| | AlBC3 | 0.35 | 0.075 | 21.4 |
| | FCD45 | 0.20 | 0.065 | 32.5 |
| | SCS13 | 0.25 | 0.065 | 26.0 |
| Draft | | | | |
| Outside | AC4C | 1 | 0.3 | 30.0 |
| | AlBC3 | 1 | 0.5 | 50.0 |
| | FCD45 | 1 | 0.5 | 50.0 |
| | SCS13 | 1 | 0.5 | 50.0 |
| Inside | AC4C | 3 | 0.8 | 26.7 |
| | AlBC3 | 2 | 0.7 | 35.0 |
| | FCD45 | 2 | 0.8 | 40.0 |
| | SCS13 | 2 | 0.9 | 45.0 |

(In prior casting method, FCD45, SCS13, are forging dies.)

TABLE 11

| | Bulk Density of Molded Articles By Prior Casting Method (X'') | | Bulk Density of Molded Articles By Present Casting Method (Y'') | Ratio (P'') |
|---|---|---|---|---|
| | Casting | Bulk Density (g/cm$^3$) | Bulk Density (g/cm$^3$) | $P'' = \frac{Y''}{X''} \times 100\%$ |
| ADC12 | Diecast | 2.771 | 2.853 | 103.0 |
| 7075 | Elongated material (extruded pull-out bar) | 2.813 | 2.806 | 99.8 |
| AC4C | Sand mold casting | 2.667 | 2.693 | 101.0 |
| | Metal mold casting | 2.681 | 2.693 | 100.5 |
| YBsC3 | Sand mold casting | 8.427 | 8.534 | 101.3 |
| AlBC3 | Sand mold casting | 7.524 | 7.613 | 101.2 |
| FCD45 | Lost wax | 7.205 | 7.262 | 100.8 |
| SCS13 | Lost wax | 7.786 | 7.854 | 100.9 |

What is claimed is:

1. A die casting machine including a casting mold comprising:

a fixed mold mounted and held on one of two fixed platens disposed in spaced relation to each other;

a tie bar mounted between said two fixed platens;

a movable plate movably mounted on said tie bar; a movable mold mounted and movably held through the movable plate on the tie bar so as to form a casting portion when said movable mold is engaged with said fixed mold;

said fixed mold and said movable mold formed of high strength ceramic;

an injection sleeve in communication with said casting portion;

piston means slidably movable in said injection sleeve for injecting and filling said molten metal into said casting mold, said injection sleeve and said piston means made of high strength ceramics;

pressure-adding means formed of high strength ceramics for adding high pressure to molten metal injected and filled into said casting mold, said pressure-adding means assembled with at least one of said fixed mold and said movable mold;

suction means for removing gases from said casting portion between said fixed mold and said movable mold;

gas vent means for removing gases from said casting portion between said fixed mold and said movable mold, said gas vent means formed at least of a porous ceramics material;

cooling means within said two fixed platens, said tie bar and said movable plate for cooling the same;

said high strength ceramics formed by a solid solutions having a construction of $\alpha$-$Si_3N_4$ $\alpha$-sialonic ceramics in a fine composite composition phase in a "partially-stabilized" $\alpha$-sialonic region where 60 vol. % of $\alpha$-sialonic granular crystals represented by $Mx(Si,Al)_{12}(O,N)_{16}$ where M is selected from the group consisting of Mg, Ca and Y, and 40 vol. % of $\beta$-$Si_3N_4$ columnar crystal coexist.

2. The die casting machine according to claim 1 wherein the fixed mold has a body portion formed with low expansion metal and is provided with a recessed core receiving portion, and a core is installed in said core receiving portion.

3. The die casting machine according to claim 1 wherein the injection sleeve comprises a double tubular construction composed of an inner tube and an outer tube, said inner tube being formed of high strength ceramics, said outer tube being formed of low expansion metal and heat resisting metal, said outer tube having an outer periphery thereof secured to and held by a sleeve cooling tubular bed.

4. The die casting machine according to claim 1 further comprising:

a molten metal storing container fixedly disposed on an upper surface of said injection sleeve and in fluid communication with a molten metal supply opening in the upper surface of said injection sleeve, said container formed of high strength ceramics and having an open portion;

cover body means formed of high strength ceramics for tightly closing said open portion of said molten metal storing container;

a heat retaining material formed of high strength ceramics in surrounding relation to an outer peripheral surface of said molten metal storing container;

heat generating means in said heat retaining material for supplying heat thereto so as to retain a temperature of molten metal stored within said molten metal storing container; and molten metal feeding pipe means connected with said molten metal storing container for periodically feeding the molten metal to said molten metal storing container.

5. The die casting machine according to claim 1 further comprising an outer portion and a gas vent channel which passes through said outer portion and is in communication with said casting portion between said fixed mold and said movable mold, and said gas vent means includes a gas vent plug in the form of a conical rod formed at least of a porous ceramics, said gas vent plug slidably and detachably inserted into said gas vent channel for reciprocable movement therein.

6. The die casting machine according to claim 1 further comprising:

movable frame bed means for mounting said movable mold on the movable plate so that said movable mold is in facing relation to the fixed mold, said movable frame bed means including a stepped connecting opening;

a receiving opening bored in said movable mold;

a stepped receiving opening bored in the movable plate through said stepped connecting opening such that said pressure-adding means is reciprocally movable from said receiving opening in the movable mold to the stepped receiving opening in the movable plate;

a pressurizing machine frame provided in a rear portion of the pressure-adding means projected from the movable plate; and crank means for starting forward movement of the pressurizing machine frame so that the pressure-adding means is moved forward by operation of the crank means.

7. The die casting machine according to claim 1 wherein said suction means includes:

a suction pipe in communication with said casting portion between said fixed mold and said movable mold, a porous vent material having a heat resistance provided on a forward end of said suction pipe, and vacuum means connected with said suction pipe for applying a vacuum thereto.

8. The die casting machine according to claim 7 wherein the porous vent material comprises porous ceramics.

* * * * *